US008695984B2

(12) United States Patent
Nicely et al.

(10) Patent No.: US 8,695,984 B2
(45) **Date of Patent: *Apr. 15, 2014**

(54) GAMING SYSTEM, GAMING DEVICE AND METHOD FOR PROVIDING DRAW POKER GAME

(71) Applicant: IGT, Las Vegas, NV (US)

(72) Inventors: Mark C. Nicely, Daly City, CA (US); Scott A. Caputo, Santa Clara, CA (US); Paul B. Stroube, Oakland, CA (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/023,065

(22) Filed: Sep. 10, 2013

(65) Prior Publication Data

US 2014/0011570 A1 Jan. 9, 2014

Related U.S. Application Data

(63) Continuation of application No. 11/937,310, filed on Nov. 8, 2007, now Pat. No. 8,534,671.

(60) Provisional application No. 60/865,584, filed on Nov. 13, 2006.

(51) Int. Cl.
*A63F 1/00* (2006.01)

(52) U.S. Cl.
USPC ..... 273/292; 463/14

(58) Field of Classification Search
USPC ..... 273/292; 463/14
See application file for complete search history.

(56) References Cited

U.S. PATENT DOCUMENTS

| | | | |
|---|---|---|---|
| 5,489,101 | A | 2/1996 | Moody |
| 5,531,448 | A | 7/1996 | Moody |
| 5,601,488 | A | 2/1997 | Kadlic |
| 5,749,501 | A | 5/1998 | Maas et al. |
| 5,775,992 | A | 7/1998 | Wood et al. |
| 5,816,915 | A | 10/1998 | Kadlic |
| 5,845,907 | A | 12/1998 | Wells |
| 5,853,325 | A | 12/1998 | Kadlic |
| 6,036,190 | A | 3/2000 | Edmunds et al. |
| 6,048,267 | A | 4/2000 | Wichinsky |
| 6,122,311 | A | 9/2000 | Watanabe et al. |
| 6,129,357 | A | 10/2000 | Wichinsky |
| 6,135,882 | A | 10/2000 | Kadlic |
| 6,146,271 | A | 11/2000 | Kadlic |
| 6,179,293 | B1 | 1/2001 | Hedman |

(Continued)

OTHER PUBLICATIONS

"Letter from Mr. McClarnon regarding disclosure of U.S. Patent No. 6,409,602; dated Aug. 8, 2008."

*Primary Examiner* — Michael Dennis
(74) *Attorney, Agent, or Firm* — Neal, Gerber & Eisenberg LLP

(57) ABSTRACT

A gaming device having a primary Three Card Poker game is provided. The Three Card Poker game includes three cards dealt to the player and the dealer, where all cards are dealt face-up. First, the player has an option to replace one card from the player's hand. Then, the dealer may replace one card according to a set of predetermined rules. The player makes a primary wager and an optional secondary wager. A primary award is provided if the player's hand beats the dealer's hand. In the secondary wager is placed, a secondary is award is provided if the either the player's or the dealer's hand is of a predetermined value.

20 Claims, 17 Drawing Sheets

(56) References Cited

U.S. PATENT DOCUMENTS

| | | | | |
|---|---|---|---|---|
| 6,358,144 | B1 | 3/2002 | Kadlic et al. | |
| 6,371,483 | B1 | 4/2002 | Edmunds et al. | |
| 6,379,245 | B2 | 4/2002 | De Keller | |
| 6,409,602 | B1 | 6/2002 | Wiltshire et al. | |
| 6,443,456 | B1 | 9/2002 | Gajor | |
| 6,503,145 | B1 | 1/2003 | Webb | |
| 6,533,279 | B2 | 3/2003 | Moody et al. | |
| 6,536,768 | B2 | 3/2003 | Caputo | |
| 6,536,769 | B1 | 3/2003 | Palacios et al. | |
| 6,568,680 | B1 | 5/2003 | Moody et al. | |
| 6,637,746 | B1 | 10/2003 | Baranauskas | |
| 6,698,759 | B2 | 3/2004 | Webb et al. | |
| 6,705,943 | B2 | 3/2004 | Awada | |
| 6,749,501 | B2 | 6/2004 | Crawford | |
| 6,805,353 | B2 | 10/2004 | Williams | |
| 7,140,614 | B2 | 11/2006 | Snow | |
| 7,334,794 | B2 | 2/2008 | Snow | |
| 2002/0185816 | A1 | 12/2002 | Moody et al. | |
| 2002/0187823 | A1 | 12/2002 | Khal | |
| 2003/0034608 | A1* | 2/2003 | Bui et al. | 273/274 |
| 2004/0183256 | A1 | 9/2004 | Ko | |
| 2005/0029744 | A1 | 2/2005 | Yoseloff et al. | |
| 2006/0049581 | A1* | 3/2006 | Buford et al. | 273/274 |
| 2006/0087082 | A1 | 4/2006 | Ko | |
| 2006/0186599 | A1* | 8/2006 | Kenny et al. | 273/292 |
| 2007/0035091 | A1 | 2/2007 | Tang | |

* cited by examiner

GAMING SYSTEM, GAMING DEVICE AND METHOD FOR PROVIDING DRAW POKER GAME

PRIORITY CLAIM

This application is a continuation of, and claims priority to and the benefit of, U.S. patent application Ser. No. 11/937,310, filed on Nov. 8, 2007, which claims priority to and the benefit of U.S. Provisional Patent Application No. 60/865,584, filed on Nov. 13, 2006, now expired, the entire contents of each of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player gets five cards dealt face up from a 52 card deck of playing cards. The player can discard none, one, a plurality or all of the five cards. Each discarded card is replaced with another card from the deck. After the replacement, the cards are evaluated for winning combinations. For a five card poker game, there are ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣ K♣ Q♣ J♣ 10♣ |
| 2 | Straight Flush | K♣ Q♣ J♣ 10♣ 9♣ |
| 3 | Four of a Kind | J♣ J♥ J♦ J♠ 3♣ |
| 4 | Full House | A♥ A♦ A♣ 6♦ 6♣ |
| 5 | Flush | A♣ J♠ 8♣ 6♣ 2♣ |
| 6 | Straight | 8♦ 7♣ 6♠ 5♠ 4♣ |
| 7 | Three of a Kind | Q♠ Q♥ Q♦ 6♦ 2♠ |
| 8 | Two Pair | 8♦ 8♥ 5♥ 5♣ 2♠ |
| 9 | One Pair | K♦ K♠ 8♣ 7♣ 2♥ |
| 10 | High Card | A♥ 10♣ 7♦ 5♠ 3♠ |

Within each category, hands are ranked according to the rank of individual cards, with an Ace being the highest card and a two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of straight flush, four of a kind, or flush, there are over a hundred equivalent hands for each two pair variation, and there are over 1,000 equivalent hands for each type of no-pair hand.

Numerous variations of poker exist, including Five Card Draw as mentioned above, Three Card Poker, Five Card Stud, Seven Card Stud, Hold'em (also called Texas Hold'em), Omaha (also called Omaha Hold'em), and Pai-Gow Poker. The variations in these games generally differ in the manner in which cards are dealt and in the manner and frequency in which bets are placed. Various criteria may also be used to determine the winning hand, including highest ranking hand, lowest ranking hand (Low-Ball), and where the high and low hands each win half of the pot (High-Low).

In certain known multiplayer variations of poker, the players play against each other rather than against a dealer or house. In certain of these variations, a round of play begins when each player has placed an initial bet, called the ante, into the pot. The term pot refers to the total accumulation of antes and wagers made during a particular game. However, in other poker variations, such as Texas Hold'em, only two players at a table make the initial bets, commonly referred to as the blinds. These blinds include a large blind and a small blind. The large blind is typically twice the value of the small blind. In a blind based game such as Texas Hold'em, all players are initially eligible to receive a hand, even if they did not place the large blind or the small blind. After the players have anted or placed the blinds, depending on the game, each player eligible for play is dealt an initial set of cards.

The number of cards dealt depends on the particular variation of poker being played. For example, in Five Card Draw, each player is initially dealt five cards. In typical Three Card Poker games where the player plays against a dealer hand, the player is dealt a total of three cards and the dealer hand includes a total of three cards as well. In certain known Three Card Poker games, the initially dealt player hand and dealer hand are final and there is no option to replace or draw any new cards. In Texas Hold'em, Five Card Stud and Seven Card Stud, each player is initially dealt two cards. These cards are typically dealt face-down. However, depending on the game, some of the cards may be dealt face-up to the player. For example, in Five Card Stud, each player is initially dealt one card face-up and one card face-down. In Texas Hold'em, each player is initially dealt two cards face-down which are commonly referred to as the hole cards.

For certain poker variations where additional cards are dealt or where cards may be replaced, after the initial deal, a first round of wagering begins, where the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by each remaining player such that each remaining player has wagered the same amount into the pot during the round.

In other known multiplayer variations of poker, the players play against a dealer or a casino rather than against each other. Some of these variations include Caribbean Stud Poker and Three Card Poker. In one variation of Caribbean Stud Poker the player places an ante wager the dealer deals a five card player hand and a five card dealer hand. One of the cards in the dealer hand is revealed to the player. After this card is revealed and the player has viewed his/her cards, the player must either make a call bet by increasing the player's stake by an amount equal to twice the original ante, or folding, in which case the player forfeits the ante. All of the cards in the dealer hand are revealed and if the dealer hand does not have and A-K or higher, the player's call bet is returned, plus an amount equal to the original ante. If the dealer hand is a A-K or better, and the player hand has a higher rank than the dealer hand, the dealer pays out even money on the ante and fixed odds on the call bet according to a pay table. This is an example of a variation of a poker game played against the casino where, in order to continue the game, the player must increase the original wager. That is, the player must either fold a smaller initial wager or increase their stake in the game. Other player versus casino poker games have features that do not allow additional wagering after the initial wager, and other game variations include one or more optionally wagering opportunities.

The poker variation of Three Card Poker is generally played with a single deck of playing cards, where the player plays against a dealer hand rather than against other players. Certain variations of Three Card Poker include one or more side games. In one example, there is a Play/Ante game where a player plays against the dealer hand to determine who has the highest hand. Also, there is a side-game commonly referred to as the Pair Plus game. In this secondary or side game, the player wagers on whether or not the player will be dealt a pair or better. Certain gaming establishments allow wagering on either of the games and other gaming establishments require a player to make an Ante Bet in order to participate in the Pair Plus portion of the game.

In one common multiplayer version of Three Card Poker, there are three wagering areas at each player position on a gaming table. One wagering area labeled Pair Plus is where the player puts a wager on the Pair Plus game. For the base game, there are two wagering areas labeled Ante and Play. The game starts with a player placing a wager in the Pair Plus and/or Ante circle. After all the players have placed their wagers, the dealer deals three cards face-up to each player. In general, if a player has wagered an Ante they must make a decision to fold or the place a Play wager in order to continue playing after looking at their hand. If the player folds, the Ante wager is forfeited without the player having ever determined if his/her hand would have beaten the dealer's hand. If a player wishes to continue, the player is required to place an additional wager in the Play wagering area equal to their Ante bet. For example, if a player wagered five credits on the Ante bet, the Play wager would also be five credits.

After all the players have determined whether to forfeit or continue playing, the dealer reveals his/her three card hand. According to certain Three Card Poker rules, the dealer must qualify with a hand of Queen or higher for play to continue. If the dealer's hand does not contain a Queen or higher, all active players are paid even money for their Ante wager even if their hand is a lower hand than the dealer hand. Also, the Play wager is returned to the player. If the dealer's hand qualifies, then the dealer's hand is compared to the player's hand. If the player's hand outranks the dealer's hand, the player is paid even money for both the Ante wager and the Play wager. If the dealer's hand beats the player's hand, the player loses both wagers. If the rank of the player's hand is the same as the dealer's hand, the player wins the wager or pushes depending on the house rules.

The hand rankings for Three Card Poker are different than the hand ranking for Five Card Poker as listed in Table 1 above. This is because the mathematical probabilities of making certain hands are different for Three Card Poker and because there are less cards (e.g., you cannot achieve two-pair when you only have three cards). The Three Card Poker hands are generally ranked from the highest to the lowest as shown in Table 2 below:

TABLE 2

Ranking of Three Card Poker Hands by Category

| Rank | Name | Example |
|---|---|---|
| 1 | Straight Flush | K♣ Q♣ J♣ |
| 2 | Three of a Kind | Q♠ Q♥ Q♦ |

TABLE 2-continued

Ranking of Three Card Poker Hands by Category

| Rank | Name | Example |
|---|---|---|
| 3 | Straight | 8♦ 7♣ 6♠ |
| 4 | Flush | A♣ J♣ 8♣ |
| 5 | One Pair | K♦ K♠ 8♣ |
| 6 | High Card | A♥ 10♣ 7♦ |

The Pair Plus wager is based only on whether a player's three card hand has a pair or higher. The Pair Plus wager is paid based on a pay table established by the gaming establishment. Therefore, even if the player loses to the dealer, if the player has a hand rank of at least a pair, the player wins the Pair Plus wager. Accordingly, a player's Pair Plus wager can be used to hedge against a frustrating loss to the dealer when the player has a good hand. An example pay table for the Pair Plus wager is listed in Table 3 below:

TABLE 3

Example Pay Table for Pair Plus Hands

| Hand Type | Payout |
|---|---|
| Straight Flush | 40-1 |
| Three of a Kind | 30-1 |
| Straight | 6-1 |
| Flush | 4-1 |
| Pair | 1-1 |

Other variations of Three Card Poker have a bonus payout on the player's hand if the player has a high enough ranking hand without regard to whether the player beat the dealer. For example, if the player did not place a Pair Plus wager, but achieved a very high ranking hand such as a Straight Flush or Three of a Kind, the player would receive a bonus payout.

Three Card Poker has become a quite popular casino table game. Three Card Poker is very easy for a player to learn, and does not take much additional player effort to master the strategy which optimizes player payback. However, the lack of interesting decision making can make this game tiresome to play for more experienced players.

Three Card Poker lacks certain game elements that are popular in other casino games. In video five card draw poker (as described above) for example, the player is given the opportunity to improve their initial hand by replacing one or more of their initial cards. In this five card draw poker game, the player is playing against a set pay table, where payouts are determined based on the rank of the player's final hand as compared to the pay table.

Also, certain players do not enjoy Three Card Poker because of the dealer qualifying rules which distances the player experience from one where the player can feel on more equal footing with his/her opponent as is the case with peer-to-peer poker games.

A need therefore exists for new and exciting poker games with high degrees of player interaction, including a need for new Three Card Poker Games.

SUMMARY

Various embodiments of the present disclosure relate to a gaming device having a Three Card Draw Poker game, and methods of playing and operating a Three Card Draw Poker game at a gaming table or through a gaming device. In one embodiment, the player plays a player hand against a dealer hand and all of the cards in the player hand are dealt face-up. All of the cards in the dealer hand are dealt face-down. The player is allowed, but not required, to replace one card in the player hand. After the player's replacement card has been dealt, face-up, or after the player has declined to replace any initial player card, the dealer reveals the dealer hand and the dealer is allowed to replace any one dealer card. If the player chooses to replace one card in the player hand, then one card is also replaced in the dealer hand. In choosing to replace a single card in the player hand, the player has a high degree of interaction in the game and can also exercise skill in analyzing the possible cards that remain in the deck. If the player's hand is higher that the dealer's hand, the player wins a primary award.

In other embodiments, the number of cards in the player hand and the dealer hand may be any suitable number such as five or seven. In these embodiments, the number of cards that may be replaced in the player hand and the dealer hand may be one or greater than one based upon the game rules. In addition, the deck of cards may also include jokers, wild cards, modifier cards, and the game may include other suitable ways to modify the cards in the player hand and the dealer hand.

In addition to the required primary wager, the player can also place an optional secondary wager. In one embodiment, a Three Card Draw Poker game is provided that allows a player to place the optional secondary wager and win a bonus prize if the highest ranking hand of the dealer's final hand and the player's final hand corresponds to hand types listed in a bonus pay table. Therefore, the player can win a large award, even if losing to the dealer in the primary game. In another embodiment, an optional secondary wager will pay the player if the player's final hand corresponds to a hand type listed in a bonus pay table. In another embodiment, an optional secondary wager will pay the player if the player's initial hand corresponds to a hand type listed in a bonus pay table. In another embodiment, an optional secondary wager will pay the player based upon some defined combination of player and dealer cards, for example, the best five card hand based upon the six final cards, relative to a bonus pay table. In another embodiment, the provided secondary wager is required to be equal to some defined proportion of the main game wager. A typical wager restriction is that the secondary wager be at least as large and the main game wager.

In one embodiment, after accepting the primary wager, the gaming device prompts the player to place an optional wager. Where the game is played at a video-based gaming console, the player inputs any primary and secondary wager by selecting an appropriate input device. The gaming device updates the players credits and indicates on a display device that the secondary wager has been placed. In various embodiments, the secondary wager is required to be greater than, equal to, or less than the primary wager. In one embodiment, the player must make the primary wager to be able to place the secondary wager. In another embodiment, the primary and secondary wagers must both be placed and be of equal size. When such a game is played at a video-based gaming console, the interface can allow the player to specify a bet to be simultaneously placed on both the primary and secondary wagers.

In one embodiment, a secondary wager award is provided to the player if the highest ranking hand of either the player's hand or the dealer's hand is one of a plurality of predetermined hand ranks. This award is based on a pay table and the pay table is typically constructed to pay larger awards for harder-to-achieve hands. It should also be appreciated that the gaming device could employ one or more progressive awards for the winning secondary game.

Thus, the optional secondary wager enables each player to participate in two different wagers simultaneously, thereby enhancing the gaming experience. Furthermore, this gives a player who has lost the primary game an opportunity to recoup at least the player's losses if the dealer hand is a high ranking hand. In certain circumstances, it is beneficial for the player if the dealer has a higher ranking hand. In certain embodiments, if the player achieves a high ranking hand, the player can win both the primary award and the secondary award.

Embodiments of the Three Card Draw Poker game may be provided by or played at a single gaming machine, a multiplayer gaming station or electronic table, each of a plurality of single gaming machines linked through a network to a progressive jackpot, or at a live gaming table with a human dealer. Although the game is particularly suited for a single player playing against a single dealer hand, it should be appreciated that the Three Card Draw Poker game may be a multiplayer game, such as at a live gaming table, as mentioned above. Other embodiments may be played remotely from the gaming establishment, such as games played on a personal computer, personal digital assistant (PDA), mobile gaming device, or cellular phone. In certain of these embodiments, a program is installed by the player or by someone else on the computer or other digital device to allow the player to play the game remotely. Alternatively, said program does not need to be explicitly loaded onto the player device but could be available by standard browser or thin-client technology by connecting through the Internet or other network by accessing one or more servers of the gaming system.

In certain embodiments, the Three Card Draw Poker is provided through a network such as the internet. In these embodiments, a player plays the game through a remote client computer such as a personal computer or a PDA device, and communicates with one or more central gaming servers through the Internet. In one such embodiment, the central gaming servers receive signals through the internet that indicate that the player or players have provided input (e.g., the player has placed a wager or input an instruction regarding game play decisions). The at least one processor of the gaming system processes the signals received through the Internet from the player to advance the play of the game. It should be appreciated, that in a multiple player game format, the gaming system receives input from different players that may be connected to the Internet at different physical locations. After the gaming system has received the necessary inputs from the players and advanced the play of the game, the gaming system provides signals back to each of the players through the Internet in order to update the players on the status of the game. For example, in a multiple player game, if a first player sends a signal through the internet to the gaming system, the gaming system processes the information and sends the updated game play status back to the first player and to any other players participating in the game. It should be appreciated that the gaming system may include one or more servers located in different physical locations and that also communicate though the Internet. It should also be appreciated that other suitable Internet configurations may be employed.

In a multiplayer game where the hands are dealt from a single deck of playing cards, typically all of the cards are dealt face-down to both the player and the dealer. Accordingly, none of the players are able to obtain an advantage over the other players by being able to view the other players' cards. In certain circumstances, in accordance with the dealer rules, the dealer may have additional information about the cards already dealt. For example, in a game having card tracking devices, the values of all of the dealt cards may be stored into a memory device connected to the gaming table, in this embodiment, a processor determines what if any card the dealer should replace and indicates same to the dealer. This aides the dealer in being able to choose a card to correctly replace the correct dealer card. In another embodiment, two or more decks of cards may be used.

When offered as cash gambling game for profit, casino games need to have some mechanisms to assure that the game should make a profit for the casino in the long term. Some variations of Three Card Draw Poker would lead to what is known as a "break-even" game, wherein there is no advantage to casino or player, which casinos usually avoid offering. Different embodiments of Three Card Draw Poker rely upon different mechanisms for assuring long-term casino profit. In one embodiment, the casino will always win ties against the player. However, such ties do not in practice occur that frequently and therefore the resulting advantage for the casino is insufficient on its own. For single-player implementations, long-term profitability can be assured by having the dealer replacement decision is made based upon knowledge of the player cards, which will include at least the player's final hand and may also include knowledge of the player's discarded card. For any game implementation, whether single-player or multi-player, whether facedown player cards or face-up player cards, there are other mechanisms for assuring long-term casino profit. In one embodiment, a required secondary side bet of a specified size relative to the main game bet would provide the required long-term casino profit. Specifically, if the main game were a break-even proposition for the player, such as under the circumstances of the player and dealer operating under the same rules, long-term profit designed into the secondary wager can assure that the combined primary and secondary proposition is likewise profitable for the casino. In another embodiment, the casino takes a commission (also known as a vig or vigorish) on all player wins, as is done in the card game Pai Gow Poker. In another embodiment, the dealer is able to draw a fourth card before deciding which originally dealt dealer card to discard.

Relative to the strength of the mechanism(s) selected for a given game definition to assure long-term casino profitability, advantageous-to-player rules may also be offered in order to somewhat counteract, though not eliminate, the casino profit advantage. Such advantageous-to-player rules include, but are not limited to, allowing the player to see some or all of the initial dealer cards before acting, having the dealer select the dealer cards before the player acts, allowing the player to see the dealer's replacement card before the player acts, allowing the player to see the dealers final hand before the player acts, etc.

In another embodiment, the card to be replaced in a player's three card hand is selected by one of the player's opponents. A single-player versus casino version is described below. After the player makes a primary wager (and any required or optional secondary wagers) the dealer is dealt three cards face-up. The player selects which of the three cards, if any, the dealer is to discard. After the player-selected dealer card is discarded and a replacement is dealt, the dealer deals three cards to the player. If the players hand is lower than the dealer's hand, the game is over and the player loses the player's primary wager. If the player's initial hand is higher than the dealer's initial hand, the dealer selects one player card to be discarded, and then deals a replacement card to the player to restore the player's card count to three. If the rank of the player hand is still higher than the rank of the dealer hand, the player is paid relative to the primary game wager. A multi-player embodiment can be offered in a similar fashion, with a rule specifying how a player is selected to be the player to decide which dealer card to discard. There are numerous mechanisms for selecting which player is to have the dealer-discard-selection ability including, but not limited to, the following mechanisms. Accordingly to one mechanism, the dealer-discard-selection ability passes from one player to the next player after each game. Accordingly to another mechanism, the dealer-discard-selection ability remains with the same player until said player loses against the dealer, at which point the dealer-discard-selection ability moves to the next player. Accordingly to another mechanism, the player with the best hand on the last round is given the dealer-discard-selection ability on the next round. In another variation, all players vote on which dealer card to select to discard.

For simplicity, the present application primarily describes the present game provided as a gaming device. In one embodiment, the gaming device enables the player to make a wager to initiate a play of the game. The player hand is dealt face-up and the dealer hand is dealt face-down from a single deck of cards. After the player has been dealt a hand, the player has the option to replace one of the cards in the player's hand. If the player opts to replace a card, the replacement card is dealt face-up from one of the remaining cards in the deck. One or more of the cards in the dealer hand are then revealed to the player. It should be appreciated that in other embodiments, the dealer's cards may be dealt face-up, allowing a player to have more of an advantage of knowing what they need to beat. Based on the player's final hand, the processor in the gaming device determines whether or not to replace one of the cards in the dealer hand. The decision to replace one of the cards in the dealer hand is made according to a set of predetermined rules or implemented in one or more suitable computer programs. If the processor determines that a card should be replaced from the dealer hand, a replacement card is dealt from one of the cards remaining in the deck face-up to the dealer hand. The processor compares the final player hand and the final dealer or casino hand. If the player's hand is of a higher Three Card Poker rank than the dealer hand, the player is provided with an award based on the pay table.

In one embodiment, the Three Card Draw Poker game is played at a live gaming table with a human dealer. The gaming table can accommodate at least one player, and preferably can accommodate a plurality of players. In one such embodiment, the Three Card Draw Poker game is played with one or more conventional decks of 52 playing cards. Prior to the start of the game, each player makes a wager on the primary game and places the wager in a primary wagering area on the table. At the same time, each player has the option of making a separate secondary wager. The separate additional wager is placed on the gaming table in a secondary wagering area on the table. This optional secondary wager functions in the same manner as where the Three Card Draw Poker game is played at a video based gaming device or console as described above. The dealer deals a hand face-up to each player and a hand face-down to himself or herself. Each player may replace up to one card, where the replacement card is also dealt face-up. After each player's hand is finished, the dealer exchanges a card according to a set of predetermined conditions or rules. The dealer determines wins and losses for the primary game and provides each player at the table with any payouts or collects each player's wagers in the event of a loss in the primary game in a conventional manner.

In another table based Three Card Draw Poker embodiment, the player hands are all dealt face-down such that players at the table are not able to see the cards of the other players. In this embodiment, the players view only their own hands and any replacement cards are also dealt face-down. After all of the players have decided whether or not to replace a card, all of the player hands are revealed. Thus, the dealer is able to see and consider all of the players cards when making the decision to replace one of the cards from the dealer's hand. In an embodiment, this advantage to the dealer may be at least partially offset by the payout scheme on the primary wager and/or the payout scheme on the optional secondary wager.

In one such embodiment, the gaming table or system includes suitable scanning or reading technologies or mechanisms that are capable of identifying the values of the dealer's and player's cards. In one embodiment, the card identification system further includes a computer tracking program. For example, where an optical reader is included in a card shoe, a computer tracking program would be able to determine the number of cards dealt and at least partially determine what cards have been dealt to the different players based in part on the rules of the game. The scanning technologies or mechanisms may be optical, based on radio frequency identification or another suitable method.

One example of this type of technology or mechanism is described in U.S. Patent Application No. 2003/0171142 to Toshiyuki et al., which discloses a card data reader where the card data recorded on the back of each player card will be read by an internal image sensor. Another example of this technology is described in U.S. Patent Application No. 2002/0042298 to Soltys et al. ("Soltys"), which discloses a table monitor that automatically images the activity occurring at a gaming table. The Soltys application describes an imaging system that makes a periodic comparison of captured images identifying player wagering, as well as the appearance, removal and position of cards and other game objects on the gaming table. A third example of a scanning/tracking technology is described in U.S. Patent Application No. 2003/0171142 to Stephen et al. ("Stephen"). The Stephen application describes a method of scanning and tracking cards in a physical deck and dealing a virtual hand of blackjack to each of the players at a gaming table, thereby allowing the players to have their cards come from an actual shuffled deck and eliminating the need for a human dealer. These patents are merely examples of the types of technologies which maybe employed. It should be appreciated that other suitable technologies may be employed.

Employing such a tracking system in the table game or system enables an automated determination as to whether the dealer should replace a card in the dealer hand. As mentioned above, the dealer must make a fast decision regarding optimal strategy. A tracking system would alleviate the live dealer from having to make a fast decision and would prevent potential strategic errors. These tracking devices reduce the distraction of the dealer from the primary Three Card Draw Poker game, which already requires a high level of the dealer's attention.

In an embodiment, the gaming table having a suitable card tracking mechanism also includes three areas on the table surface for each of the three cards in the dealer hand, where each of the three areas include an indicator. The indicators may be any suitable audio or visual indicator such as an LED. In this embodiment, the dealer deals one card face down to each of the three areas to form the dealer hand. The card tracking technology (which is also be incorporated at each of the player positions) tracks each of the cards dealt. When a player chooses to replace a card, the selected card is removed from the respective tracking area at the player position, and a new card is dealt face-up in the same tracking area from the cards remaining in the deck. The tracking system identifies the value of this replacement card. After all of the players have chosen to replace a card, the dealer reveals the dealer hand. Then, the processor determines, based on the tracked cards stored in a memory device and based on the set of predetermined rules, which of the dealer cards should be replaced. The processor then causes the indicator associated with the card to be replaced to indicate same to the dealer. Accordingly, the dealer quickly and accurately knows what card should be replaced. It should be appreciated that in other embodiments, the gaming table includes a separate display or displays such as an LCD, a CRT, or other suitable display device.

In an embodiment, a tracking system is employed as discussed above that enables the dealer to track the wagers of the individual players. In this embodiment, the decision to replace a card in the dealer's hand can be based, at least in part, on the amount of the players' wagers. For example, if seven players are playing at a table with six players placing the minimum wager and one player placing the maximum wager, a decision to replace one of the cards in the dealer hand would be influenced, at least in part, by the cards in the hand on the player placing the maximum wager. Therefore, the dealer strategy may include information about the cards remaining in the deck, the cards played, and the amounts of the player's wagers.

Employing such tracking technologies and by providing a display screen (either a community screen on or above the table or multiple individual screens) the present disclosure provides the opportunity to enable each player to effortlessly recall cards previously discarded by the other players and may lead to increased enjoyment and excitement for players.

In an embodiment, the gaming device or system includes suitable tracking technologies or mechanisms for determining the values of the cards dealt to the dealer hand and the cards dealt to the player hand. In an embodiment where the gaming system is played at a gaming table with a live dealer, the gaming system quickly calculates the optimal strategy and indicates to the dealer which card, if any, that the dealer should replace. This calculation is based on the rules of the game and is also based on the tracked cards that have dealt to the player and the dealer. Therefore, the gaming system disclosed herein solves the technical problem of a human dealer not being able to make such quick and accurate strategic decisions in the plays of the game regarding which card to replace in the dealer's hand by providing a display which instructs the dealer which card to discard based on the players cards and the dealer cards.

Additional features and advantages are described herein, and will be apparent from, the following Detailed Description and the figures.

BRIEF DESCRIPTION OF THE FIGURES

FIG. 2B is a schematic diagram of the data network that one or more of the gaming devices of the present disclosure may be connected to.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

In one embodiment, the game may be provided over a network such as the Internet. In another embodiment, the game may be provided for use on a personal digital assistant (PDA) or cellular telephone. In these embodiment, the player downloads the game to a local computing device or devices and is able to play the game in a separate location from the actual gaming establishment. In addition, in a multiplayer embodiment, several players can log on to a central server and play the game with several other players that are playing at different locations.

Figure 1A:
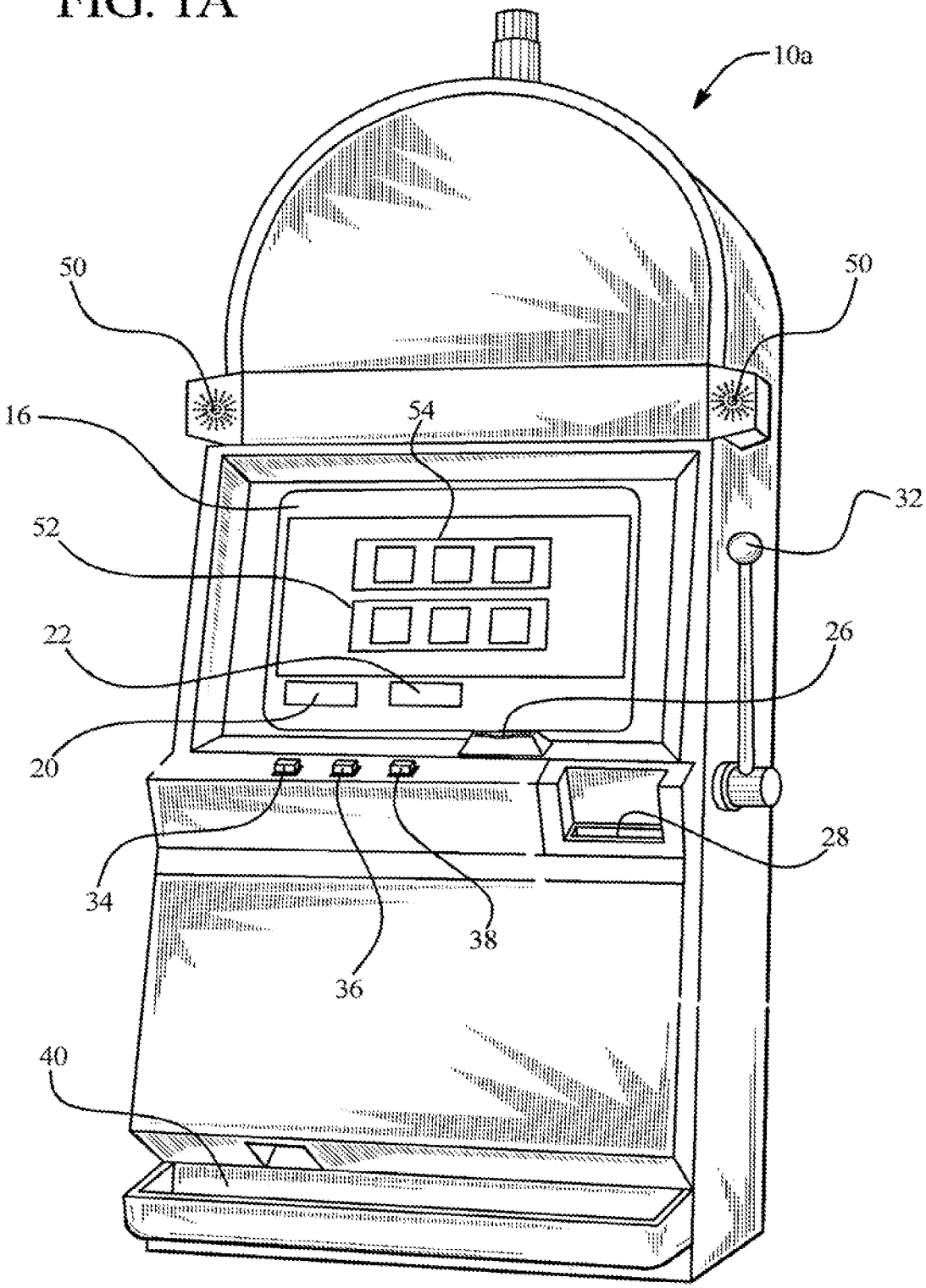
FIG. 1A is a front perspective view of one embodiment of the gaming system of the present disclosure.
Figure 1B:
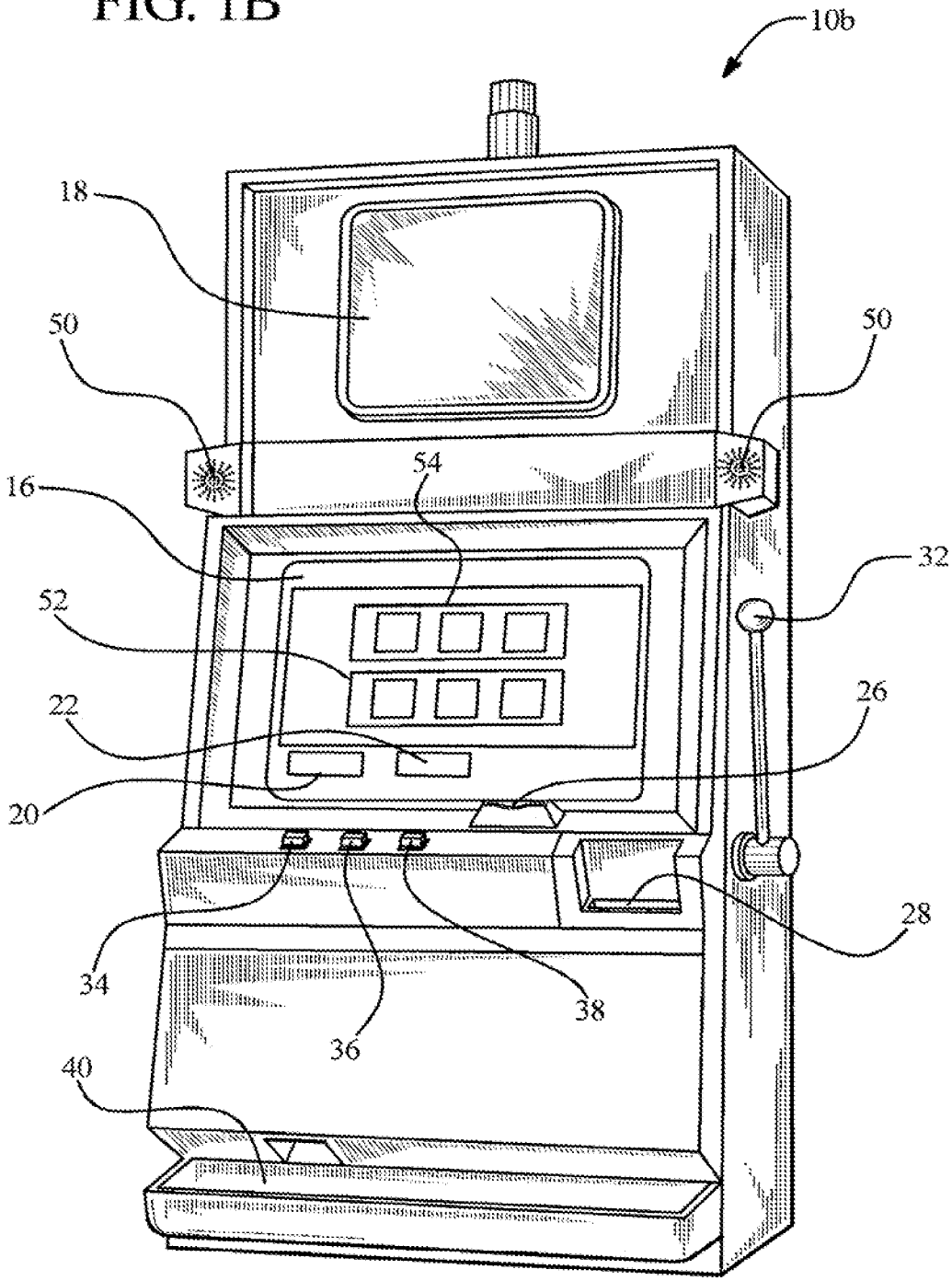
FIG. 1B is a front perspective view of one embodiment, of the gaming system of the present disclosure.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
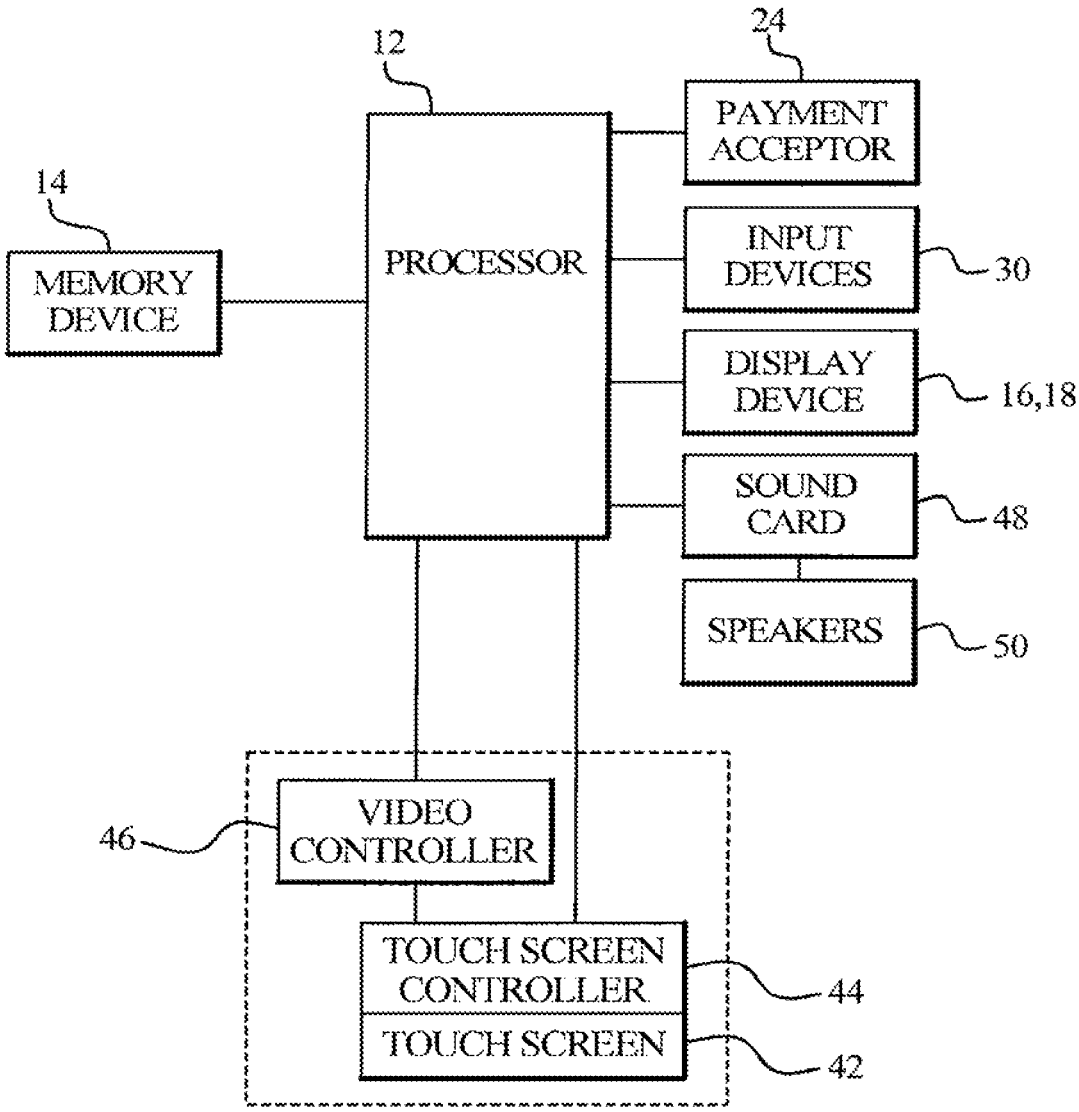
FIG. 2A is a schematic diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
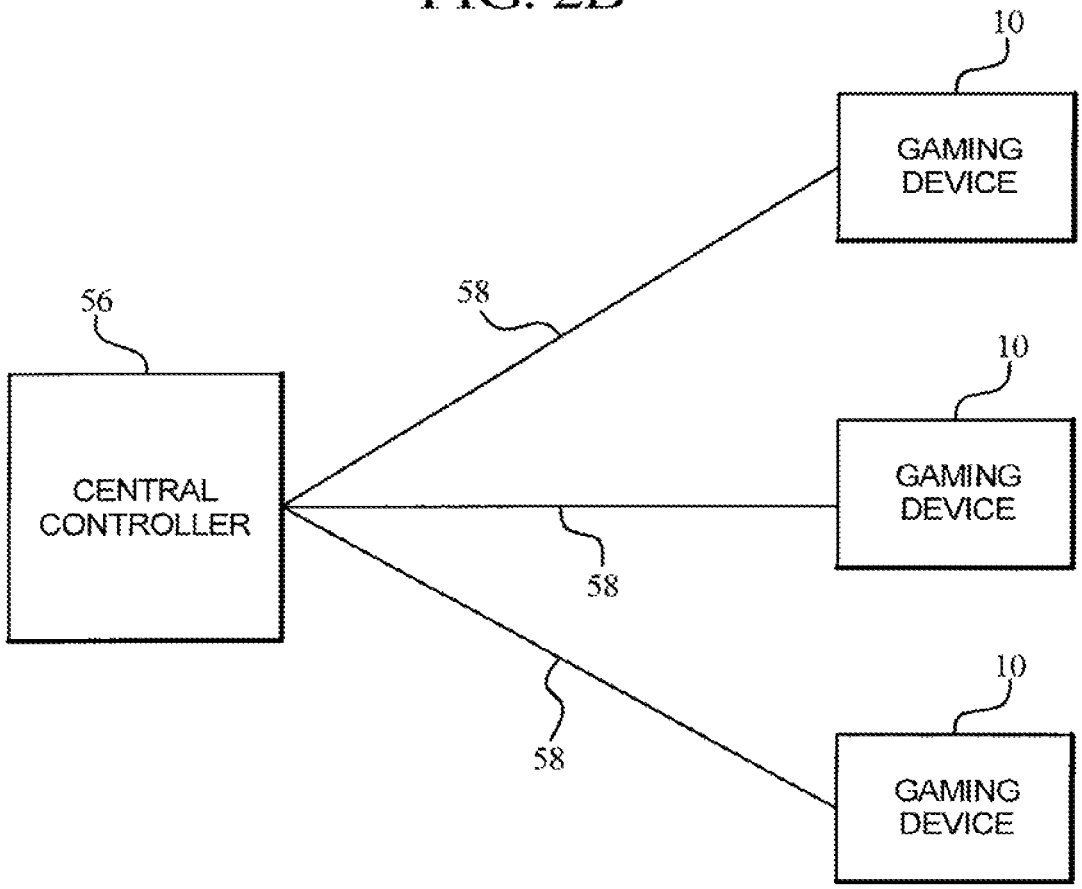

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

One or more embodiments of the present disclosure comprise a gaming system including a live table game and an activity tracking and reward system. The tracking system is configured to collect and store raw data relating to the wagering activities of players at a gaming table. The present disclosure also includes methods of utilizing the obtained data. For example, the data may be used to calculate the house rake, where the house rake may be based on the size of the pot at the end of a hand. In one embodiment, certain criteria are applied to the obtained data to determine if a player qualifies to receive a progressive jackpot award. In another embodiment, the collected data is analyzed to determine a player's wagering history to determine whether or not the player is entitled to certain complimentary items. In another embodiment, the gaming system notifies a player that a seat is vacant at a poker table, where the player is located at a remote gaming device or gaming table.

Three Card Draw Poker Primary Game Embodiment

As shown in FIGS. 1A and 1B, in an embodiment, the gaming device 10 incorporates a Three Card Draw Poker game where the gaming device initially deals the player three cards face-up to form a player hand and three cards face-down to form a dealer hand. The cards are dealt from a single virtual conventional deck of fifty-two cards. In other embodiment, two or more decks of cards may be used, and one or more of the decks may contain different number of cards other than the standard fifty-two cards. Cards may be dealt as in a traditional game of cards or in the case of the gaming device, may also include that the cards are randomly selected from a predetermined number of cards. In one embodiment, the player has the option to replace one of the initially dealt three cards. If the player wishes to replace one card, the player selects the card to replace via one or more input devices, such as by pressing related hold buttons or via a touch screen. The player then presses the deal button and the unwanted or discarded card is either removed from the display or placed in a different position of the display so the player can still view any discarded card. Then, the gaming machine deals the replacement card face-up from the remaining cards in the deck. This results in a final three-card player hand. After the player has the final three-card hand, the gaming device reveals the dealer hand and causes up to one card to be replaced in the dealer hand. The replacement of the card in the dealer hand may be based, at least in part, on the player's final three card hand, a determination of what cards remain in the virtual deck, and the conventional Three Card Draw Poker hand rankings. In other embodiments, the replacement of the card in the dealer hand may also be based, at least in part, on whether a secondary wager is placed and how the dealer hand changes may affect the secondary wager outcome. The gaming device then utilizes conventional Three Card Draw Poker hand rankings to determine whether the player or the dealer has the higher ranking hand. The gaming device provides the player with an award based on a winning hand and the credits the player wagered.

In other embodiments, the base or primary game may be a multiple hand video based version of Three Card Draw Poker. In one embodiment, the gaming device deals at least two player hands face-up and at least two dealer hands face-down, where all the cards are dealt from a single virtual deck of cards. In another embodiment, the player's first hand is dealt face-up and the player's second hand is dealt face-down, where the player's second hand is not revealed until the player has completed his/her playing decisions with the first hand. After the player has optionally replaced one card in the first hand, the card is replaced and the player's final first hand is determined. Then the cards in the player's second hand are revealed. The player then chooses to replace up to one card in the player's second hand. In a multiple hand version where three or more player hands are played, the above process of revealing cards is repeated accordingly.

In another embodiment, where the multiple hand game is played from a single deck of playing cards, all of the player's cards in all of the player's hand are initially dealt face-up. The player chooses up to one card to be replaced in each hand. In determining whether to select a replacement card for each hand in a single deck game, the player will have somewhat of an advantage because the player knows the value of six of the fifty-two cards (unlike the embodiment above where the cards in the second and third hands are not initially revealed to the player). Moreover, the gaming device has a slight additional advantage over the player because the determination to replace a card in each the dealer's hands is made after the player has optionally replaced one card in each of the player hands. For example, in a multiple hand game where the player can play two hands, when the player makes a determination to replace one card from each hand, a total of eight player cards are revealed. Therefore, because the gaming device has knowledge of the six cards in the two dealer hands, only thirty-eight cards in the deck are unknown to the gaming device. Similarly, if the player chooses not to replace any cards, a total of forty cards in the deck are unknown to the gaming device. Accordingly, there is a slight advantage where the gaming device replaces cards after the player has replaced cards, because the gaming device has additional information about which cards are depleted from the deck, and because the gaming device is aware of what outcome is required to beat the player hand(s). That is, the gaming device knows the final player hand(s), and therefore knows what hand(s) it must beat. Similarly, because the player is the first to act, the player does not know the hand(s) that he/she must beat (i.e., the player is playing against an unknown dealer hand). After the gaming device replaces any cards according to a set of predetermined rules, the poker hand rankings are determined hand by hand and any awards are provided to the player.

In an embodiment of multiple hand play, the player plays multiple hands against respective multiple dealer hands. In one embodiment, the first player hand and the first dealer hand are dealt from a first virtual deck of fifty-two cards. Then, the second player hand and the second dealer hand are dealt from a second and different deck of cards. This process is continued for any number of player and dealer hands. In this embodiment, the player optionally replaces up to one card in the players first hand from the first deck of cards. Then, the dealer replaces up to one card from the first deck of cards according to the rules of the game and with consideration of the previously dealt player cards. This process is repeated for the second and third player and dealer hands as well.

In another embodiment, only a single virtual deck of cards is used and each of the player's initial first, second, and third initial hands include the same cards. Also, the dealer's initial first, second and third hands include the same cards dealt from the same virtual deck of the cards. In one embodiment, all of the replacement cards for the player hands and dealer hands are taken from the remaining cards in the single virtual deck. In another embodiment, each replacement card is dealt from a different virtual deck of cards. In this example, there is a possibility that one or more of the player's final hands may be the same. The gaming device then discards up to one card. This selected card is discarded from each of the three dealer hands. Similar to the replacement cards in the player hands, the replacement cards for the dealer hand are taken from either a single virtual deck of cards or from different virtual decks of cards, according to the embodiments. The gaming device compares each of the player hands to the dealer hands and then the gaming device provides any awards to the player.

In an embodiment of multiple hand play, the gaming device deals three player hands face-up and one dealer hand face-down. In this embodiment, all of the cards in the three player hands are dealt from the same single deck of cards. Accordingly, the player plays three different hands against one dealer hand. The player is allowed to replace one card from each of the three hands, where the replacement cards are drawn from the same single deck. Similarly, the gaming device discards up to one of the cards in the dealer hand according to the rules of the game. The gaming device compares each final player hand to the final dealer hand any payouts or awards are determined. It should be appreciated that although the embodiments described above involve a single deck of cards, in a multiplayer or multi-hand game, multiple decks may be used. It should also be appreciated that other multi-hand embodiments may be employed in accordance with the present disclosure.

Figure 3:
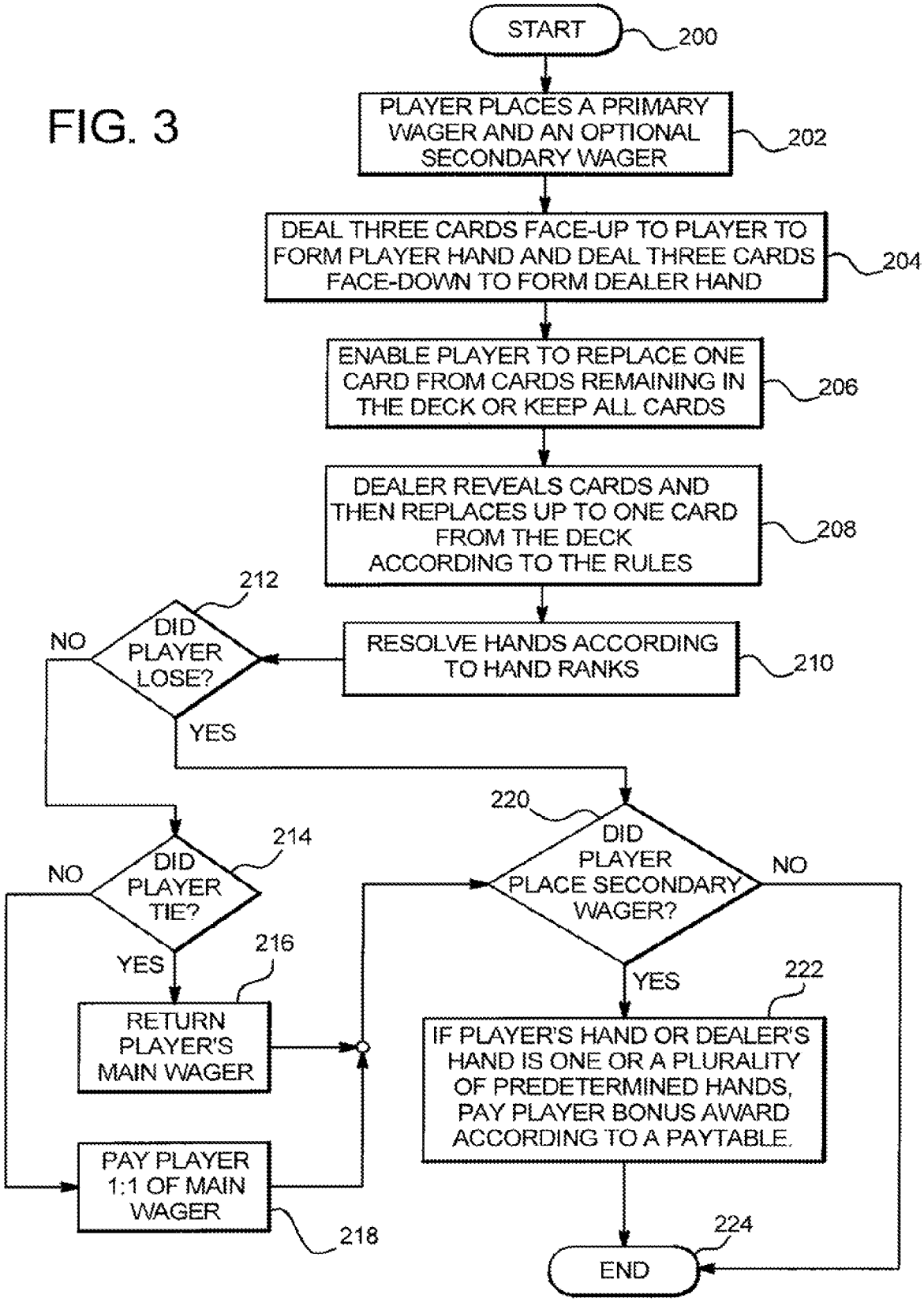
FIG. 3 is a flow diagram of the operation of one embodiment of the present invention.

The operation of one embodiment of the present disclosure is generally illustrated in FIG. 3. FIG. 3 includes a general overview of the operation of one embodiment of the gaming system where the game is a Three Card Draw Poker game. The gaming system initiates the poker game as indicated in step 200. The gaming device prompts the player to make a required primary wager and an optional secondary wager, as indicated by block 202. In an embodiment, if a player places the secondary wager, the player is eligible for a bonus award depending on the final dealer hand, the player's final hand, or a combination of the final dealer hand and the player's final hand. In one embodiment, any bonus awards are based on the strongest final hand, which may be either the player hand or the dealer hand and is determined according to a pay table.

After the primary wager and optional secondary wager have been placed, the gaming device deals three cards face-up to form a player hand and three cards face-down to for a dealer hand, as indicated by block 204. In one embodiment, all of the cards for the player hand and the dealer hand are dealt from a standard deck of fifty-two cards. In a table game, the cards are dealt from a pre-shuffled standard physical deck of cards. In an individual video based gaming console, the cards are dealt from a virtual deck of fifty-two cards. It should be appreciated that in other embodiments, the Three Card Draw Poker game may be dealt from two or more decks of cards, and these decks may contain one or more Jokers. In one or more Jokers are available in the deck, such Jokers may be assigned usage rules including, but not limited to, being treated as a general Wild card which substitutes for any other card, or being treated as a Pai Gow Poker style Joker.

In another embodiment, the cards of the dealer hand are dealt face-up. Because all of the cards are dealt face-up, the player knows what cards are in the dealer hand. Similarly, the gaming device knows what cards are in the player's hand. In the single deck embodiment, the face-up cards give both the player and the gaming device additional information about what cards remain in the deck. For example, if the player's hand includes one Ace and the dealer hand includes two Aces, both the gaming device and the player know that there is only one Ace left in the deck. In this example, the player may choose to discard the Ace (even though it a high ranking card) knowing that the odds of drawing and pairing the Ace are 46:1 (one Ace left out of the forty-six cards remaining in the deck).

In an embodiment, where the dealer cards are dealt face-down, after the three cards have been dealt to form a player hand and a dealer hand, the gaming device enables the player to replace one card, as indicated by block 206. The player may choose to keep all three cards if the player believes that his or her hand is strong enough as is. In one embodiment in which the dealer's cards are dealt face-up, if the initial dealer hand sufficiently outranks the player's hand such that no card drawn by the player would at least tie the dealer hand, then the player is not offered a chance to replace a card. For example, if the dealer hand is Q♠ Q♥ Q♦ and the player's hand is A♥ 10♥ 7♦, then the player would be drawing dead (i.e., no card would beat the dealer hand). If the player were to discard the 7♥ and draw an Ace or a Heart, the resultant hand of a pair of Aces or a Flush would still not beat the dealer hand of Q♠ Q♥ Q♦.

After the player has received a replacement card, the gaming device replaces none or up to one card in the dealer's hand, as indicated by block 208. In an embodiment, the dealer determines whether or not to replace a card according to set of house rules. The house rules include a set of rules that apply when the dealer's initial hand is better than the player's final hand and a set of rules that apply when the player's final hand is better than the dealer's hand, as discussed in further detail below and as summarized in Tables 4 and 5 below:

| Rule | Description | Example |
|---|---|---|
| 1 | Do not replace any card that can result in the dealer losing its standing against the player. | Dealer: A♥ 4♦ 3♦<br>Player: K♥ 6♠ 7♣ |
| 2 | Do not replace any card that would cause the dealer to drop in pay table standing. | Dealer: K♥ Q♥ 4♥<br>Player: J♣ 8♦ 3♣ |
| 3 | Do not replace any card if the dealer hand cannot be improved. | Dealer: A♥A♦ A♣ |
| 4 | If Rules 1, 2, 3 are met, and the player has placed the optional secondary wager, replace the card that can lead to the highest outcome on the pay table. | Dealer: A♥ A♥ Q♣<br>(replace 4♥)<br>Player: J♣ 8♦ 3♣ |
| *** | When applying Rules 1 to 4, always consider the cards that have been dealt to the player and the dealer. | |

TABLE 5

Example Rules When Initial Dealer Hand is Worse Than Player Hand

| Rule | Description | Example |
|---|---|---|
| 5 | Replace whatever card would most likely result in a hand that would beat the player. | Dealer: A♣ 4♣Q♣<br>Player: K♠ K♣ 3♦ |
| 6 | Do not replace any card if player hand cannot beat. | Dealer: 4♣ 6♣ J♦<br>Player: A♥ A♦A♣ |
| 7 | If more than one card could be replaced with equal odds of beating the player hand, replace the card that could lead to the highest poker outcome. | Dealer: A♣ 4♥ Q♣<br>Player: J♣ 8 ♦ 3♣<br>(replace dealer 4♥) |
| *** | When applying Rules 5 to 7, always consider the cards that have been dealt to the player and the dealer. | |

In one example of Rule 1 from Table 4 above, if the dealer hand is better than or equal to the player's final hand, the gaming device does not replace any card that could result in the dealer hand losing it's standing against the player's hand. For example, if the dealer hand is A♥ 10♦ 9♦ and the player has only a King high after drawing, the gaming device should not replace the A♥ to try for the straight flush. In another example of Rule 1, in a version of the game where the dealer wins any ties against the player, if the dealer's hand is A♥ A♦ 9♦ and the player's hand is A♣ A♠ 9♣, the gaming device should not replace the 9♦ to try for a higher kicker (i.e., a kicker refers to a card in a poker hand that does not itself take part in determining the rank of the hand, but that may be used to break ties between hands of the same rank). This is because it is possible, and even probable, that the dealer will draw a card lower than a nine and lose. In a third example of Rule 1, if the dealer hand is A♥ A♦ 2♦ and the player's hand is A♣ A♠ 2♠, the gaming device should replace the 2♦ to try for a higher kicker because it is impossible for the gaming device to draw anything less than a two to reduce the rank of the dealer hand. It is possible that the gaming device will draw another two and tie, but the gaming device will not draw to a losing hand. Accordingly, in these examples, when the dealer hand is greater than or equal to the player hand, the gaming device should not draw a card that would cause the dealer hand to lose this status.

In one example of Rule 2 above, if the dealer hand is better than or equal to the player's final hand, the gaming device should not replace any card that could cause the dealer's hand to drop its pay table standing. For example, if the dealer hand is K♥ Q♥ 4♥ and the player's hand is eight high, the dealer hand is a winning hand and cannot lose even if the gaming device would replace any of the three cards. However, the gaming device could potentially improve upon the heart flush by replacing the 4♥ and trying to draw either the A♥ or the J♥ to complete a straight flush. If the gaming device was able to draw to a higher dealer hand, the player could potentially win the optional secondary wager. In one embodiment, the secondary wager affords a player who has won or lost the primary wager to win an additional award if the highest ranking hand of the player's hand and the dealer's hand is a predetermined rank. For example, the predetermined ranks could be Three-of-a-Kind or a Straight Flush or a Royal Flush. Therefore, under this example Rule 2, when the dealer hand already is a winning hand, the gaming device would be prohibited from exchanging a card that could potentially provide the player with a large secondary wager award. However, it should be appreciated that in a different embodiment, the gaming device would be required to replace a card in the dealer hand or the player could opt for the gaming device to replace a card in the dealer hand.

In one example of Rule 3 above, if the dealer hand is better than or equal to the player's final hand, the gaming device should not replace any card if the dealer hand cannot be improved. For example, if the dealer hand is 6♥ 6♦ 6♠, there is no card that would improve the dealer hand. Thus, the gaming device would not replace a card in the dealer hand. In this example, the player would likely lose the primary wager (i.e., not having a hand with a rank of three-of-a-kind or better) but would win the optional secondary wager. This is because the best ranking hand of the dealer hand and the player hand (i.e., 6♥ 6♦ 6♠) is one of the predetermined ranks corresponding to a secondary award. As mentioned above, the predetermined ranks can include Three-of-a-Kind, Straight Flush or Royal Flush, or other suitably high ranking hands. In addition, if the deck of cards includes wild cards or other modifiers, these cards may be used to form one of the predetermined ranks in either the player hand or the dealer hand. If the gaming device was allowed to replace one of the three sixes, the player could potentially lose out on the secondary award. Therefore, this example Rule 3 prevents the gaming device from intentionally reducing the rank of a winning hand to prevent a player from winning a large secondary award.

In one example of Rule 4 above, if the dealer hand is better than or equal to the player's final hand, the gaming device should replace a card that would potentially result in the highest ranking dealer hand, provided that the replaced card would not cause the rank of the dealer's final hand to be less than the rank of the player's final hand. For example, if the initial dealer hand is A♥ 4♥ Q♣ and the player's final hand is Q♦ 9♣ 4♦, the gaming device could replace either the Q♣ to try for a heart flush or the gaming device could replace the 4♥ to try for a straight. That is, because the dealer's high card (A♥) is greater in rank than the player's high card (Q♦), replacing the Queen could not possibly result in a dealer loss to the player. As discussed above, in Three Card Draw Poker, the rank of a straight is generally higher than the rank of a flush because of the relative probabilities of obtaining each. Therefore, in this example, the gaming device should discard the 4♥ to try for the higher ranking straight hand. It should be appreciated that the gaming device can take into account the cards remaining in the deck in determining whether to try for the lesser ranking hand. Using the example above, if the game is a multiplayer game and three Kings have already been dealt, the gaming device is able to determine that only one King remains in the deck. However, as many as eleven hearts remain in the deck to complete a flush for the dealer hand. Under these circumstances, the gaming device should replace the Q♣ because, although the straight is a higher ranking hand than the flush, there is a relatively low probability of achieving the straight. Accordingly, under this example Rule 4, the gaming device should draw a card that would have the statistically greatest potential award benefit to the player.

In another example of Rule 4, if the dealer hand is A♥ 4♦ J♣ and the player's hand is J♥ 8♣ 3♦, the gaming device would replace a card to try to form a pair. According to the rules above, the gaming device would not replace the Ace because it could potentially result in the dealer hand losing to the player hand. In addition, the gaming device has a better probability of forming a pair of Fours in the dealer hand than a pair of Jacks. This is because there are three Fours remaining in the deck and only two Jacks (i.e., the player was dealt a Jack).

Therefore, in these example rules, if the dealer hand is a guaranteed winning hand, the gaming device must replace a card that would allow the dealer hand to potentially form a hand having a higher rank. Accordingly, because the gaming device is required to try for a higher ranking hand, the player has an additional opportunity to win the secondary award if the rank of the final dealer hand is one of the predetermined ranks. However, it should be appreciated that in another embodiment, if the dealer hand is a winning hand, the gaming device does not draw a card. In another embodiment, the dealer will only attempt to improve a winning initially dealt dealer hand if the player has placed a second wager which depends upon the dealer improving a hand. Such an embodiment is meant to avoid wasting unnecessary time and to avoid giving the player the impression that the dealer isn't satisfied simply beating the player but wants to beat the player with an even stronger hand. Moreover, in another embodiment, if the dealer hand is a winning hand, the gaming device only replaces a card if a replacement card could potentially result in the dealer hand having one of the predetermined ranks.

As mentioned above, another set of house rules apply when the player's final hand is better than the initial dealer hand. In one example of Rule 5 from Table 5 above, if the dealer hand is worse than the player's hand, the gaming device should replace a card that will most likely lead to a dealer hand that will beat or tie the player hand. In this example Rule 5, the gaming device must take into account which cards remain in the deck. For example, if the initial dealer hand is A♥ 4♥ Q♣ and the player's final hand is K♠ K♣ 3♦, the dealer should replace the Q♣. If the dealer were to replace the 4♥, there are only five cards in the deck that would form a pair of Aces or a Straight to beat the player (i.e., K♥, K♦, A♦, A♠ and A♣). However, if the dealer were to replace the Q♣, there are fourteen cards in the deck that would form a pair of Aces or a Flush to beat the player hand (i.e., A♦, A♠, A♣ and the eleven remaining hearts). Therefore, under this set of rules, the primary goal for the gaming device is to beat the player hand rather than to try for the highest ranking hand possible. In general, trying for the highest ranking dealer hand is secondary to trying to beat the player hand.

In one example of Rule 6 in Table 5 above, if the dealer hand is worse than the player's hand, and if the player's hand cannot be beaten or tied, the gaming device does not replace a card. For example, if the dealer hand is A♥ 4♠ Q♣ and the player's hand is K♦ K♠ K♣, there is no single replacement card that would allow the dealer hand to win. With regard to the secondary bonus award, because the player's hand is guaranteed to be the highest ranking hand of the player hand and dealer hand, there is no reason for the gaming device to replace a card to try for a higher ranking hand.

I In one example of Rule 7 in Table 5 above, if the dealer hand is worse than the player's hand, and if more than one card has the same best odds to beat or tie the player, the gaming device must replace a card that can lead to the highest poker outcome. For example, if the dealer's hand is A♥ J♠ 3♠ and the player's hand is A♦ 10♣ K♦, the gaming device could discard either the J♠ or the 3♠ because replacing either card gives the dealer hand five possibilities to beat the player (i.e., A♠, A♣, J♥, J♦, J♣ and A♠, A♣, 3♥, 3♦, 3♠, respectively). However, if the gaming device discards the 3♣, the replacement card can potentially form a pair of Jacks in the final dealer hand, which is higher in rank than a pair of Threes. Depending on the pay table for the secondary wagering game, the pair of Jacks may be one of the predetermined ranks, whereas the pair of threes may not be. Therefore, if the initial dealer hand has more than one card that has the same odds to beat the player, the gaming device should replace the card that results in the highest possible ranking poker hand.

Although several example rules that dictate replacing a card in the dealer hand have been described, it should be appreciated that in other embodiments, additional rules may apply. In a table game embodiment with a live dealer, the dealer may have a list of the house rules. Alternatively, the gaming table includes a processor and a display device for displaying the applicable rules to the dealer. In another embodiment, the gaming table additionally includes any suitable card tracking mechanism and technology as described above that enables a processor to store information in a memory device with regard to the cards dealt to the player and the dealer. In this embodiment, the processor causes the display device to indicate to the dealer which, if any, card should be replaced.

Referring back to FIG. 3, after the gaming device has replaced up to one card according the above described or other suitable rules, the hands are resolved, as indicated by block 210. If the rank of the player's hand is less than the rank of the dealer hand, the player loses the primary wager. If the rank of the player's hand is the same as the rank of the dealer hand, the gaming device returns the player's primary wager to the player, as indicated by decision diamonds 212, 214 and block 216. It should be appreciated that in another embodiment, if the player hand ties the dealer hand, the player loses the primary wager, if the rank of the player's hand is greater than the rank of the dealer hand, the gaming device pays the player 1:1 of the main wager, as indicated by decision diamonds 212, 214 and block 218. However, it should be appreciated that any suitable payoff ratio other than 1:1 may be used. As described above in the example rules, it may be possible to determine the outcome of the hands before the player and/or the gaming device draws a card. For example, if the initial dealer hand is A♥K♥Q♥ and the player does not have two of three cards to form a Straight Flush, the player cannot possibly win.

After the primary wager payoff has been determined, the gaming device determines if the player placed a secondary wager, as indicated by decision diamond 220. If the player did not place the secondary wager, the game ends, as indicated in step 224. If the player placed the secondary wager, and if the highest ranking hand of the dealer hand and the player's hand is a predetermined rank, the gaming device provides the player with a bonus award according to a pay table. As mentioned above, the hands that are the predetermined rank may be a Three-of-a-Kind, a Straight Flush, a Royal Flush, or any other suitable high ranking or randomly determined hand, where these predetermined hands may include jokers, wild cards, or other modifying elements. For example, if either the player hand or the dealer hand is a Straight Flush (i.e., A♥K♥Q♥), the payoff to the player is 50:1 on the secondary wager. It should be appreciated that the payoff for a Straight Flush or Three-of-a-Kind may be any suitable payoff ratio. After the dealer pays the player the bonus award, the game ends, as indicated in step 224.

Figure 4A:
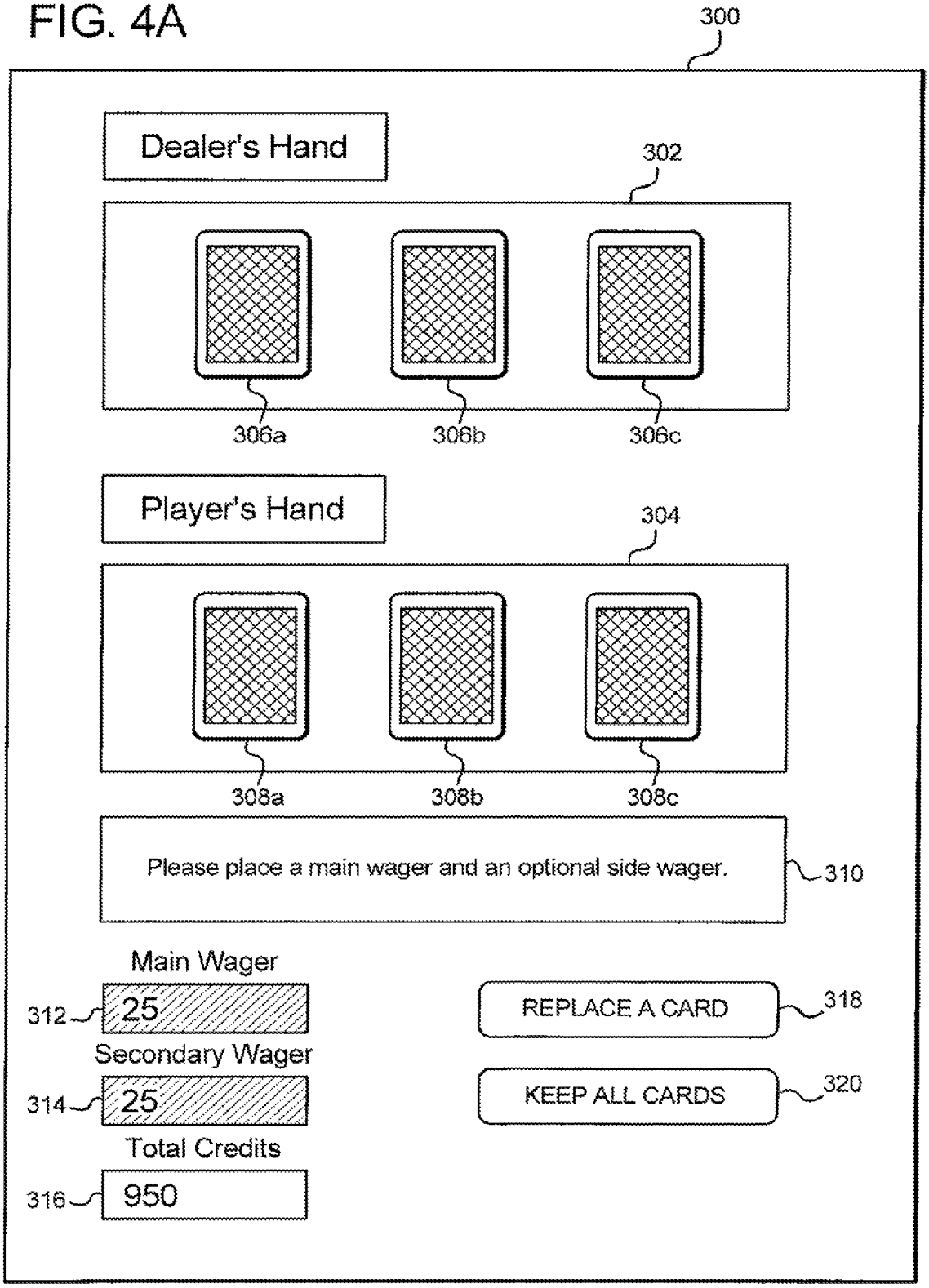
FIGS. 4A, 4B, 4C, 4D and 4E are illustrations of screen displays for a round of the game, where the player and the dealer both opt to replace a card and where the player wins the primary wager.

FIGS. 4A to 4E illustrate an example play of Three Card Draw Poker game played at an individual video based gaming console, according to an embodiment. As illustrated in FIG. 4A, in an embodiment, the gaming device includes a primary game display device 300 that displays a dealer hand 302 and a player hand 304. The dealer hand 302 includes three cards 306*a*, 306*b* and 306*c* dealt face-down. The player hand 304 includes three cards 308*a*, 308*b* and 308*c* that are dealt face-up only after the player has placed the primary wager and optionally placed the secondary wager. In this embodiment, the player's cards are known to both the player and the gaming device prior to any cards being replaced in the dealer hand or the player hand. The display device 300 includes a message display 310, a main wager display 312, an optional secondary wager display 314, a total credits display 316, a replace card input 318, and a keep all cards input 320. FIG. 4A illustrates the beginning of a round of play. The message display 310 displays a message to the player to prompt the player to make a main wager and an optional secondary wager. In this example, the player wagered twenty-five credits as a main wager and twenty-five credits as a secondary wager, as indicated in the main wager display 312 and the secondary wager display 314. The total number of credits is nine-hundred and fifty, as indicated by the total credits display 316.

Figure 4B:
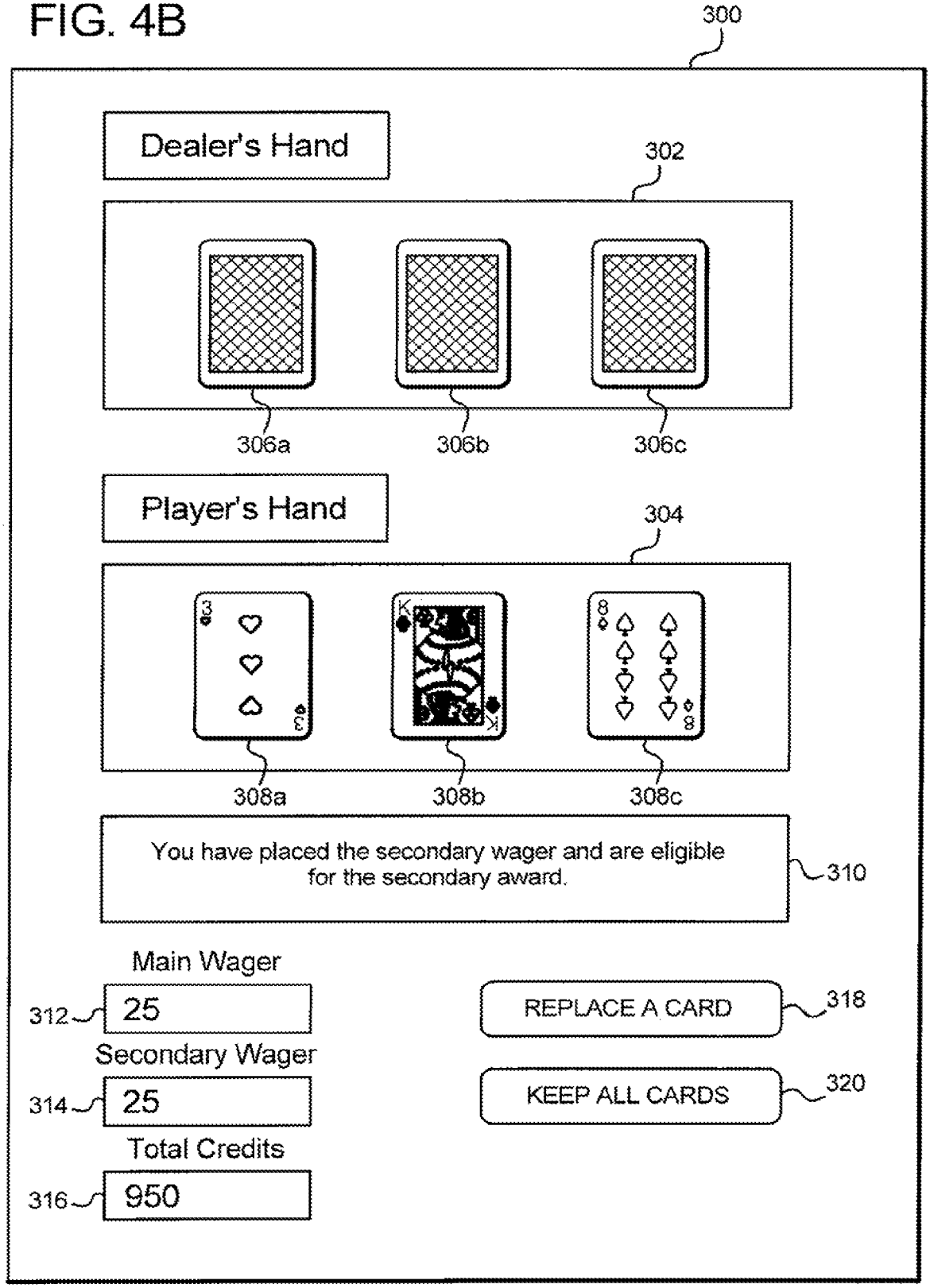

As illustrated in FIG. 4B, the gaming device deals three cards 308*a*, 308*b*, and 308*c* face-up to the player to form the player's initial hand 304. Also, the gaming device deals three cards 306*a*, 306*b*, and 306*c* face-down to form the initial dealer hand 302 (the dashed lines on the cards in the dealer hand indicate that these cards are not yet visible to the player). The processor causes the message display 310 to confirm that the player placed the secondary wager and is eligible for the secondary award. In this example, the player's initial hand 304 is 3♥ K♠ 8♣ and the initial dealer hand 302 is A♥ 4♥ Q♣.

Figure 4C:
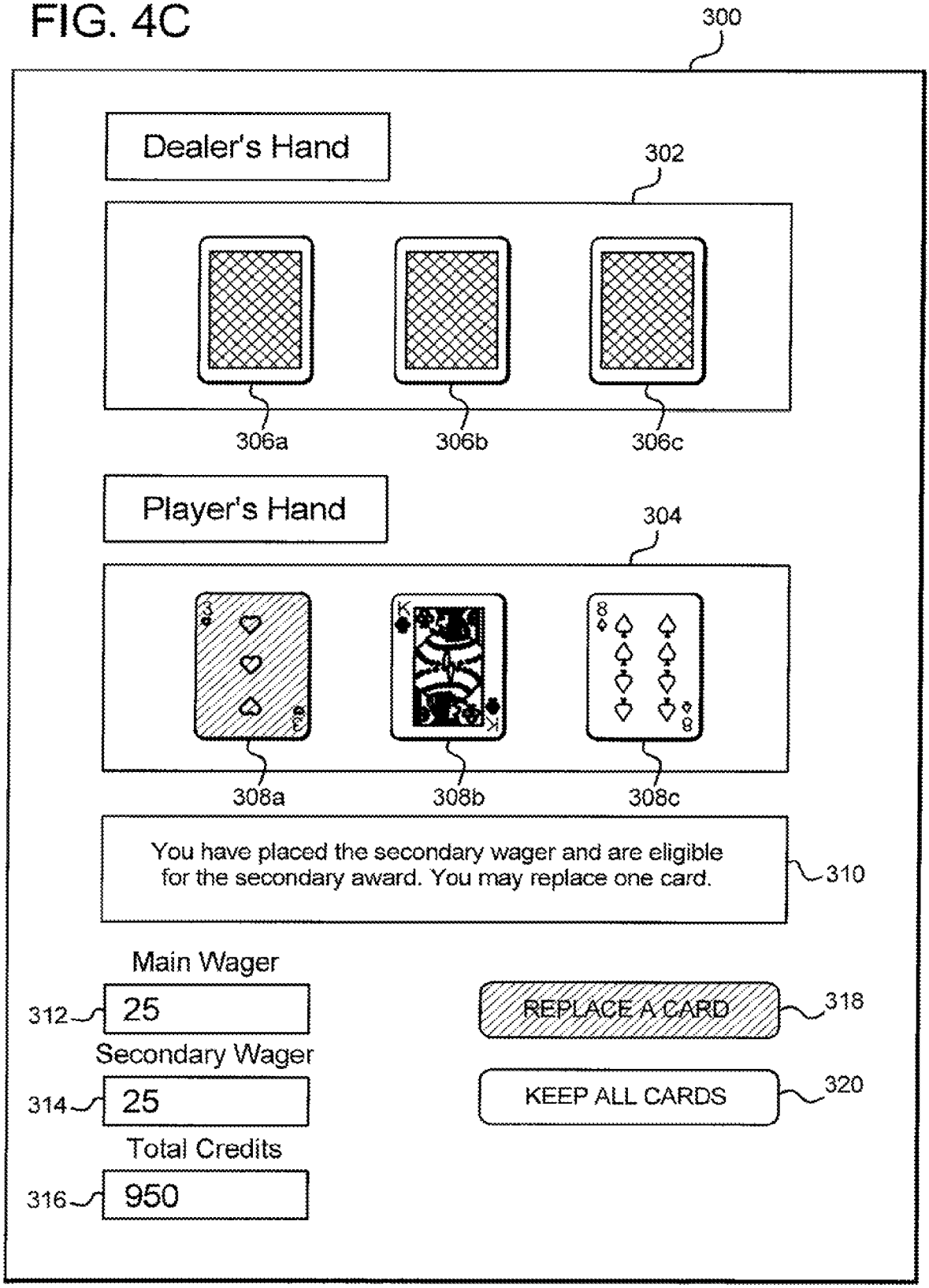
Figure 4D:
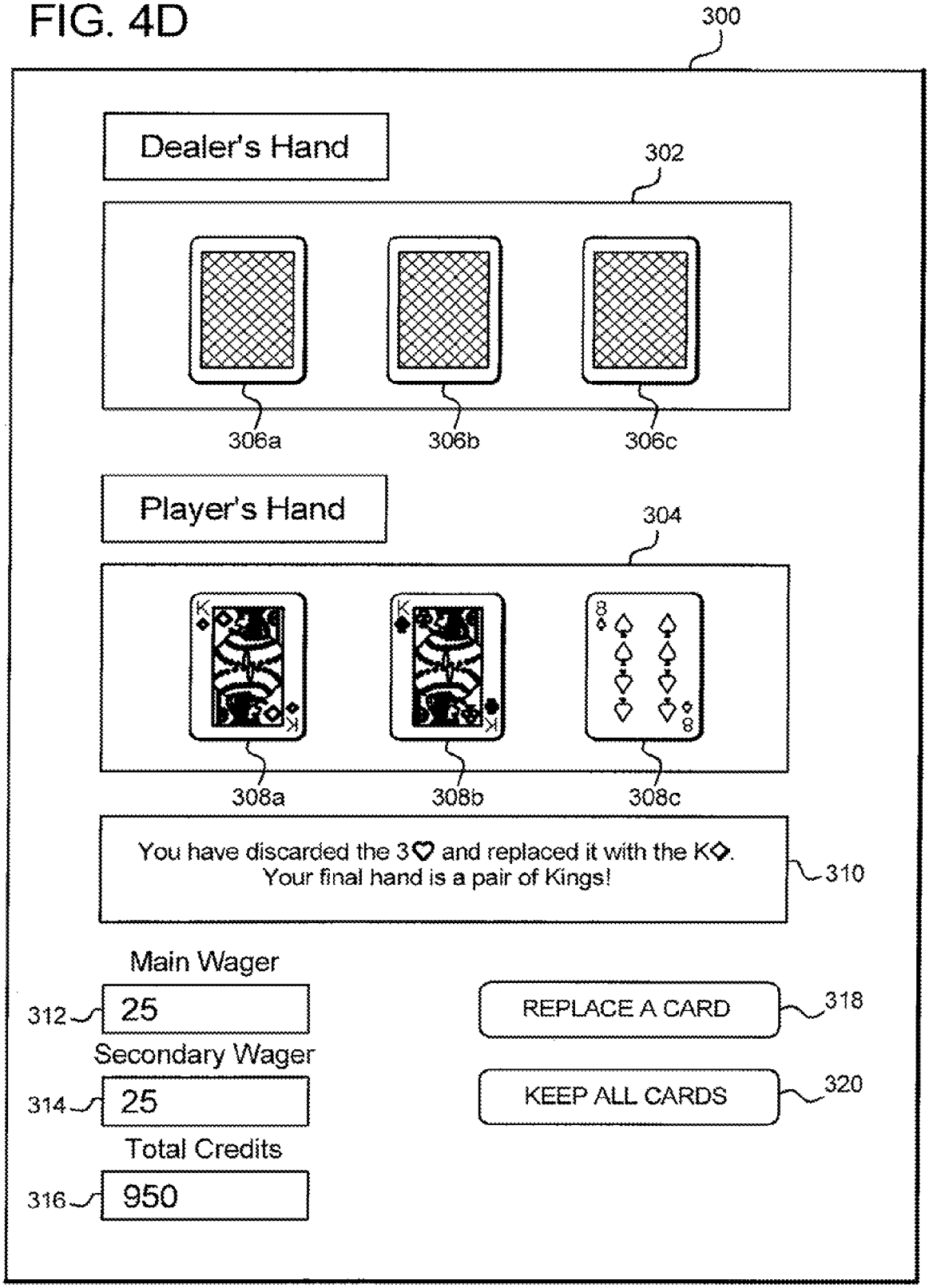

As illustrated in FIG. 4C, the processor causes the message display 310 to indicate that the player may optionally replace one card. In this example, the player chooses to replace the first card 308*a* which is a 3♥, by selecting the replace a card input 318 and selecting the appropriate card (as indicated by the dashed lines). In this case, the player is hoping to draw either a King or an Eight to form a pair. As illustrated in FIG. 4D, the player's replacement card 308*a* is the K♦. Thus, the player's final Three Card Draw Poker hand is a pair of Kings, as indicated on the message display 310. At least at this point, the player has the highest ranking hand of one pair, while the dealer hand is merely an Ace high hand.

Figure 4E:
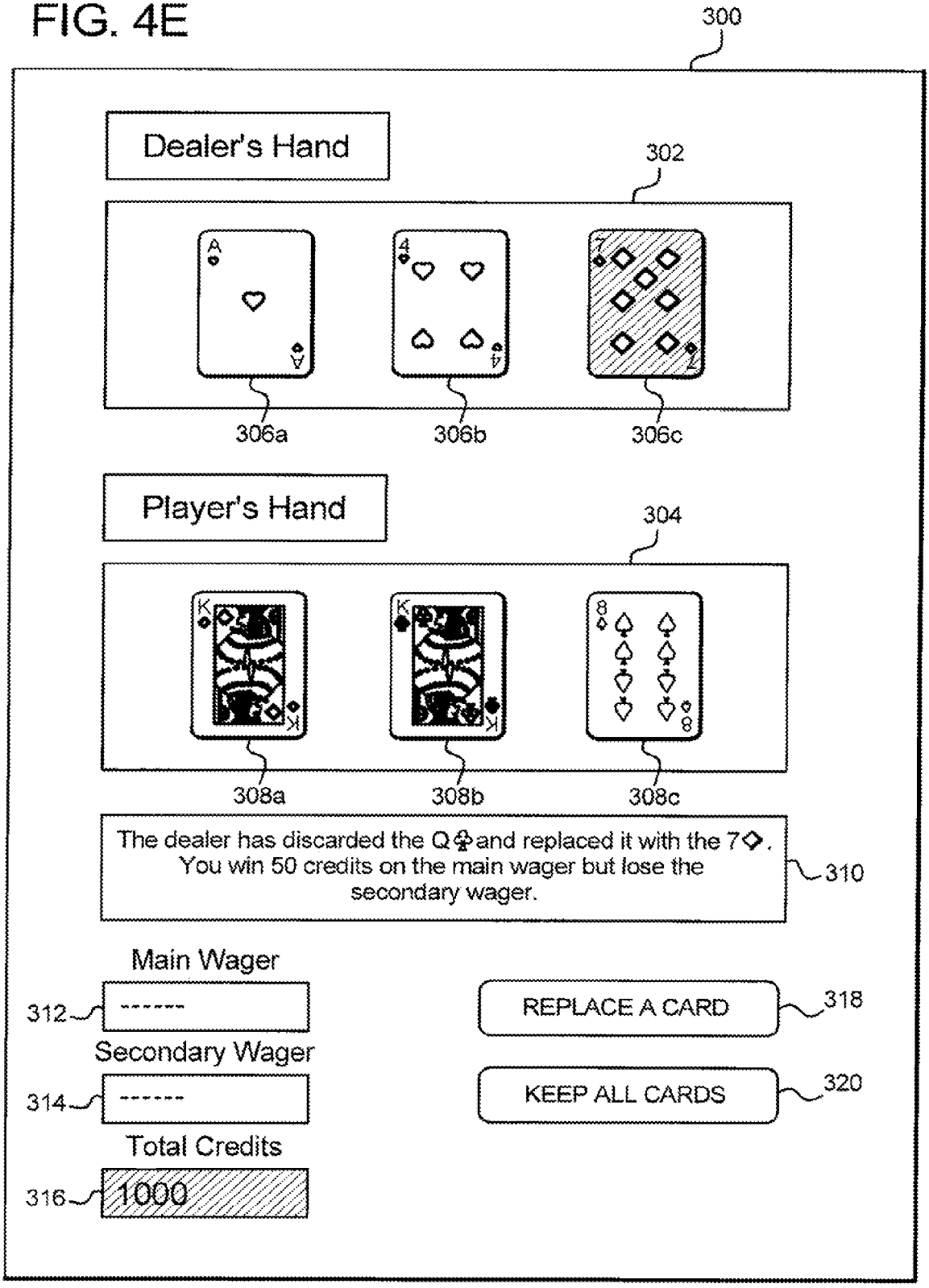

As illustrated in FIG. 4E, the gaming device now has an opportunity to replace a card in the dealer hand according to the house rules, as discussed above. In this example, the rank of the initial dealer hand 302 is less than the rank of the player's final hand 304. As described above in example Rule 5, if the dealer hand is worse than the player's hand, the gaming device should replace a card that will most likely lead to a dealer hand that will beat or tie the player hand, taking into account which cards remain in the deck. In this example, the initial dealer hand 302 is A♥ 4♥ Q ♣ and the player's final hand 304 is K♠ K♣ 8♠. Therefore, the gaming device should replace the Q♣. As mentioned above, if the gaming device were to replace the 4♥, there are only five cards in the deck that would form a Straight in the dealer hand to beat the player hand (i.e., K♥, K♦, A♦, A♠ and A♣). However, if the gaming device were to replace the Q♣, there are fourteen cards in the deck that would form a Flush in the dealer hand and beat the player hand (i.e., A♦, A♠, A♣ and the eleven remaining hearts).

In this example, the replacement card 306*c* in the dealer hand is a 7♦, as indicated by the message display 310. Because the rank of the player's final hand is greater than the rank of the final dealer hand, the gaming device pays the player 1:1 on the main wager. In this case, the player is paid fifty credits, as indicated by the updated total credits display 316 and the message display 310. The player's total number of credits is now one-thousand. However, in this example, the highest ranking hand of the player's hand and the dealer hand is only a pair of Kings. In this example, this is not one of the plurality of predetermined hands that pay on the secondary wager. Accordingly, the player loses the secondary wager, as indicated by the message display 310.

FIGS. 5A to 5E illustrate a second round of play where the player loses the primary wager, but wins on the secondary wager. The message display 310 displays a message to the player to prompt the player to make a main wager and an optional secondary wager. In this example, the player wagered fifty credits as a main wager and fifty credits as a secondary wager, as indicated in the main wager display 312 and the secondary wager display 314. The total number of credits remaining is nine-hundred, as indicated by the total credits display 316.

Figure 5A:
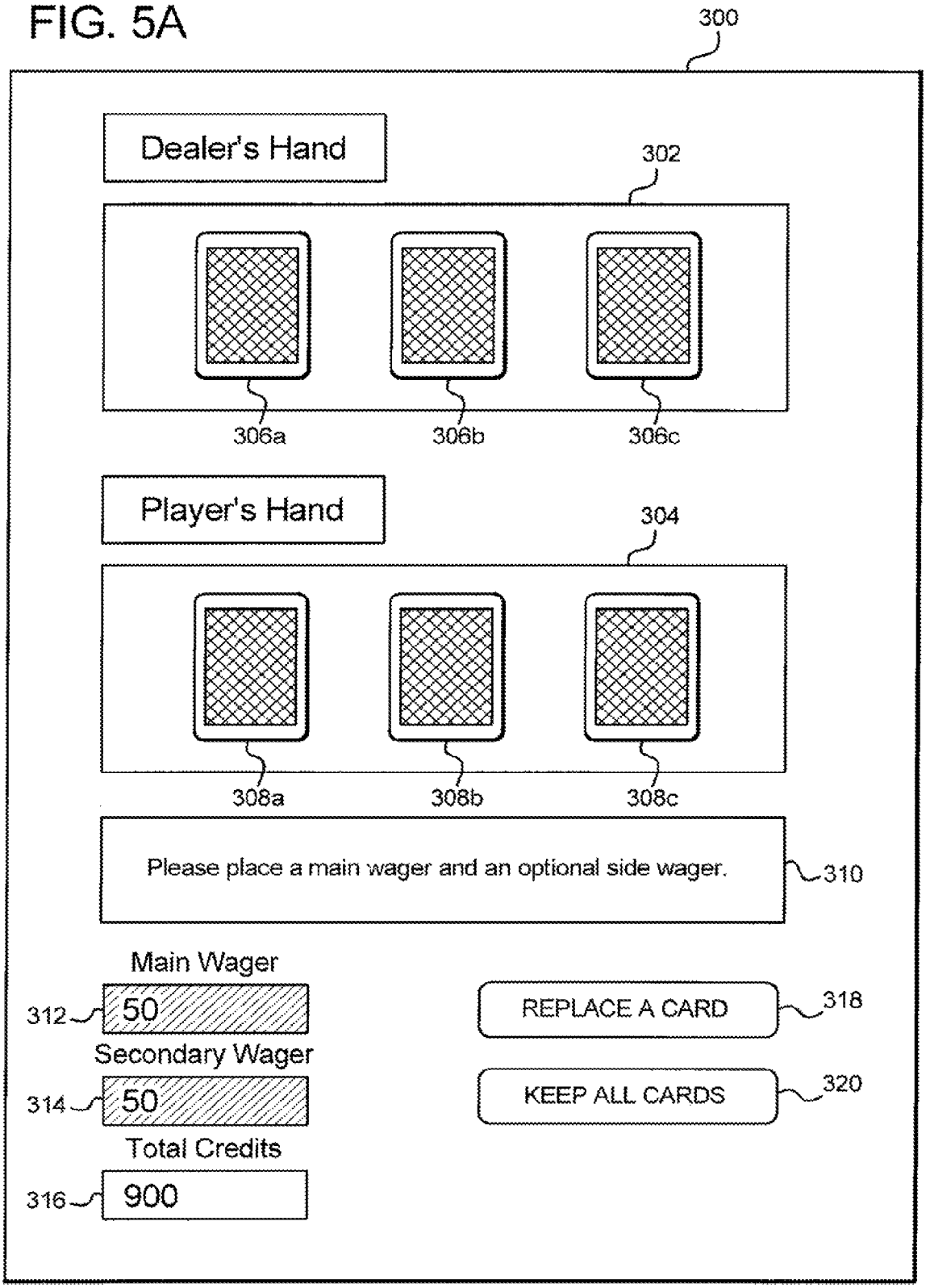
FIGS. 5A, 5B, 5C, 5D and 5E are illustrations of screen displays for a round of the game, where the player and the dealer both opt to replace a card and where the player loses the primary wager and wins the secondary wager.
Figure 5B:
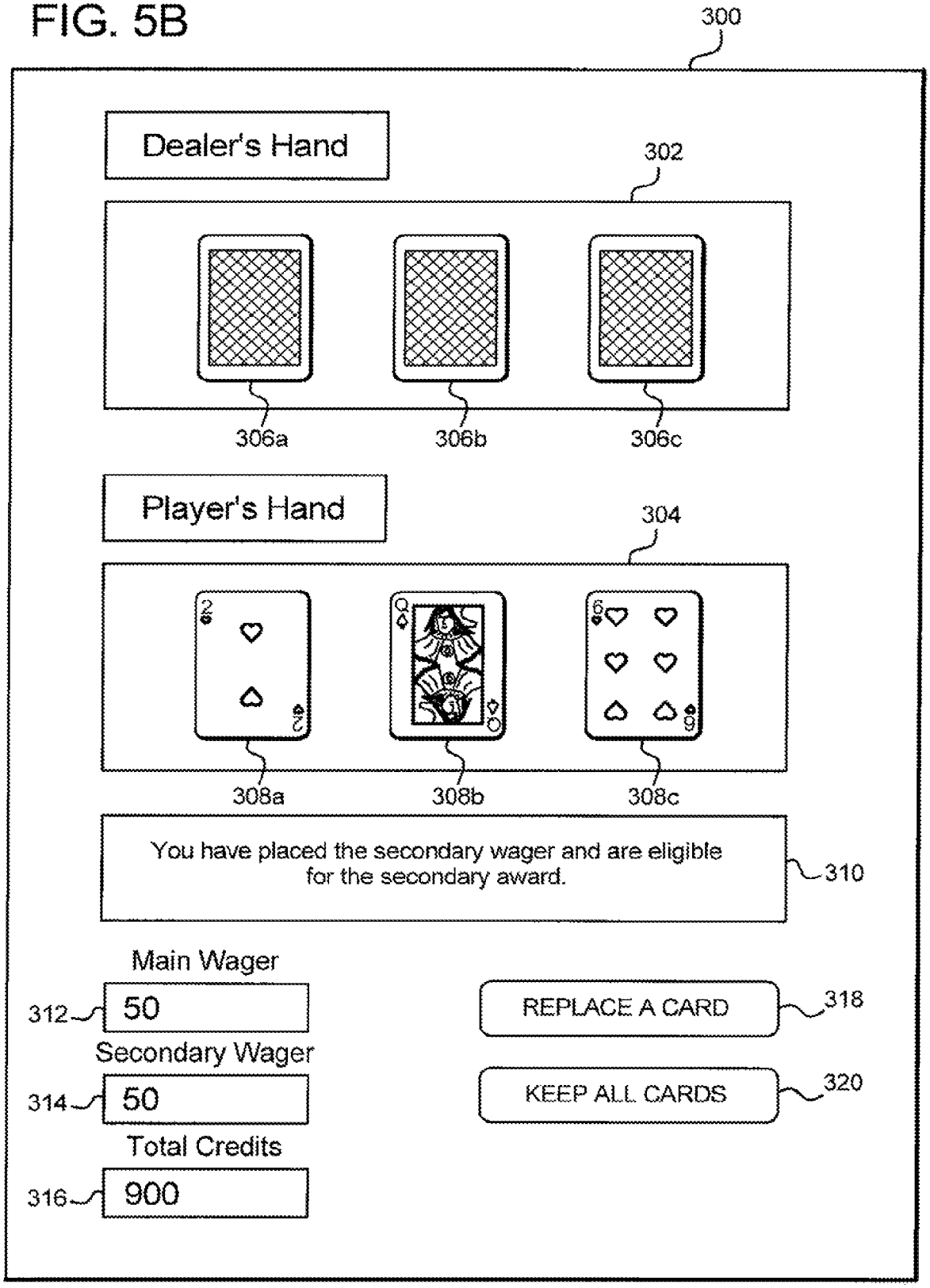

As illustrated in FIG. 5B, the gaming device deals three cards 308*a*, 308*b*, and 308*c* face-up to the player to form the player's initial hand 304. Also, the gaming device deals three cards 306*a*, 306*b*, and 306*c* face-down to form the dealer's initial hand 302 (the dashed lines on the cards in the dealer hand indicate that these cards are not yet visible to the player). Also, a processor causes the message display 310 to confirm that the player placed the secondary wager and is eligible for the secondary award. In this example, the player's initial hand 304 is 2♥Q♠ 6♥ and the initial dealer hand 302 is A♥ 4♥ A ♣. Thus, the dealer hand includes a pair of Aces and the player hand includes Queen high with two of three hearts to form a heart flush.

Figure 5C:
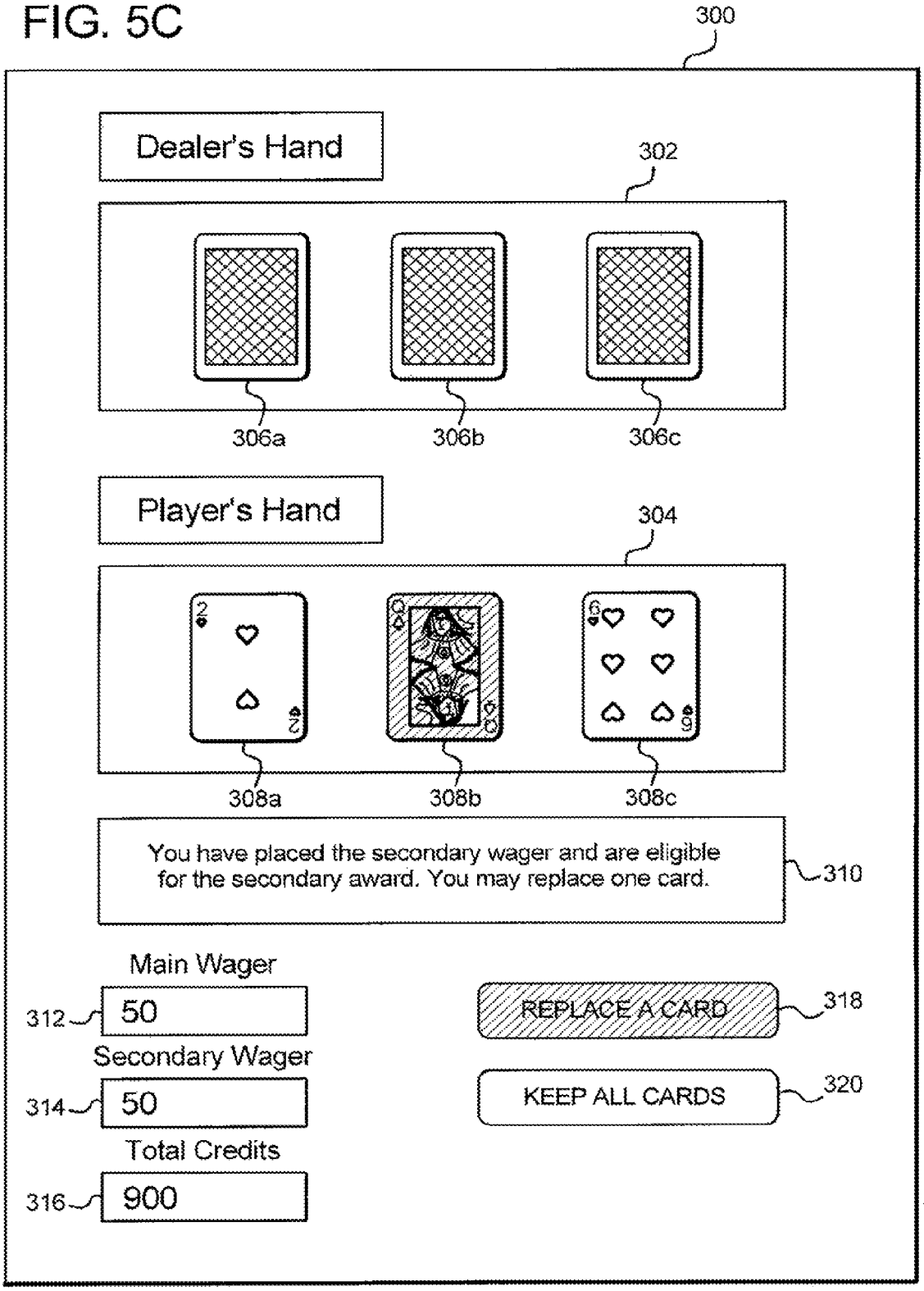
Figure 5D:
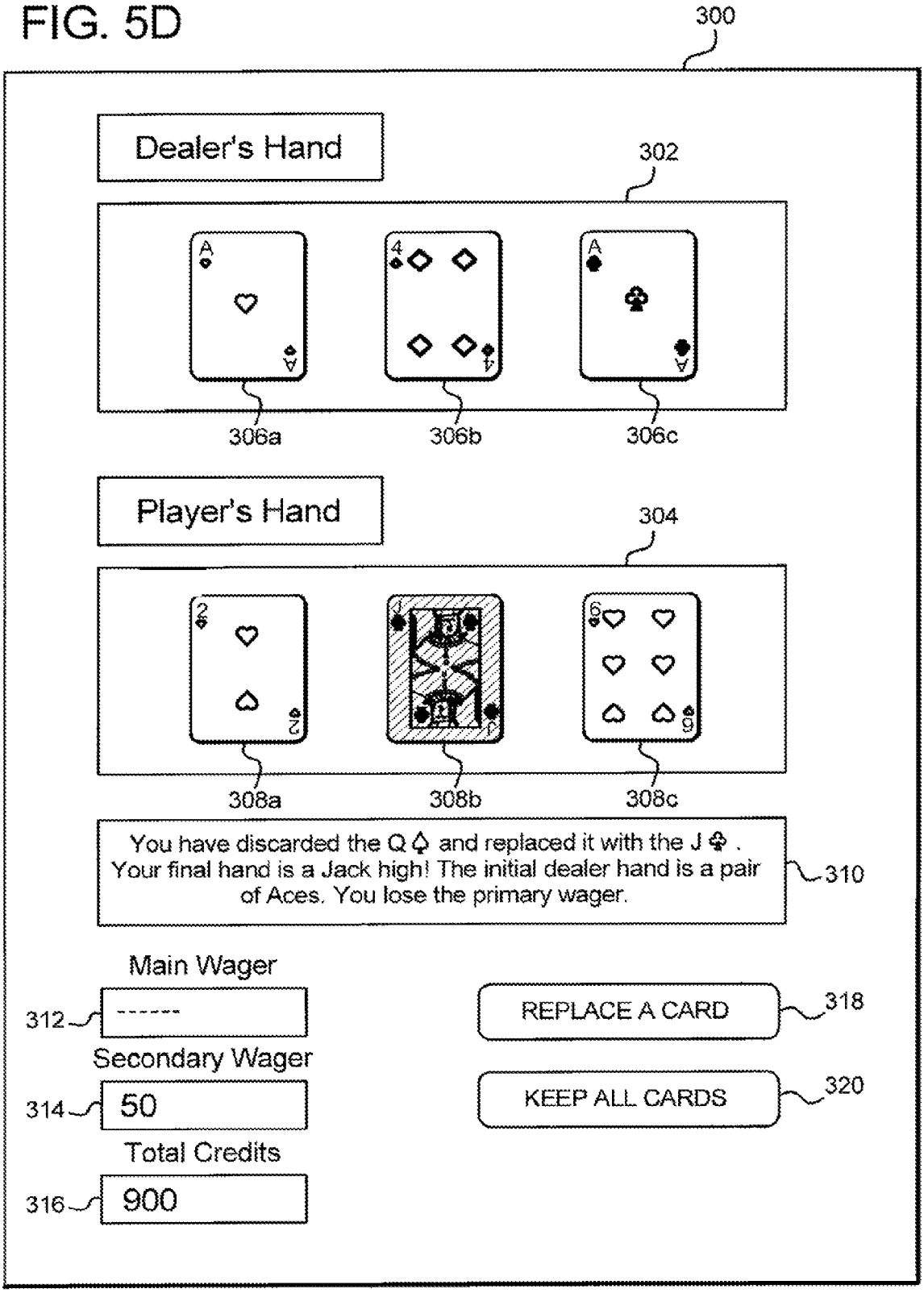

As illustrated in FIG. 5C, the processor causes the message display 310 to indicate that the player may optionally replace one card. In this example, the only way that the player can potentially beat the dealer's pair of Aces is to try for the heart flush. In this example where the dealer hand is not visible to the player, the player chooses to replace the second card 308*b* which is the Q♠, by selecting the replace a card input 318 and selecting the appropriate card 308*b*. In this case, the player is hoping to draw any of the remaining ten hearts to form a flush. As illustrated in FIG. 5D, the players replacement card 308*b* is the J♣. Thus, the player's final Three Card Draw Poker hand is simply Jack high, as indicated on the message display 310. At this point the player has lost the primary wager because the dealer's initial hand of A♥4♦A♠ has a higher rank than the player's final hand of 2♥J♣ 6♥.

Figure 5E:
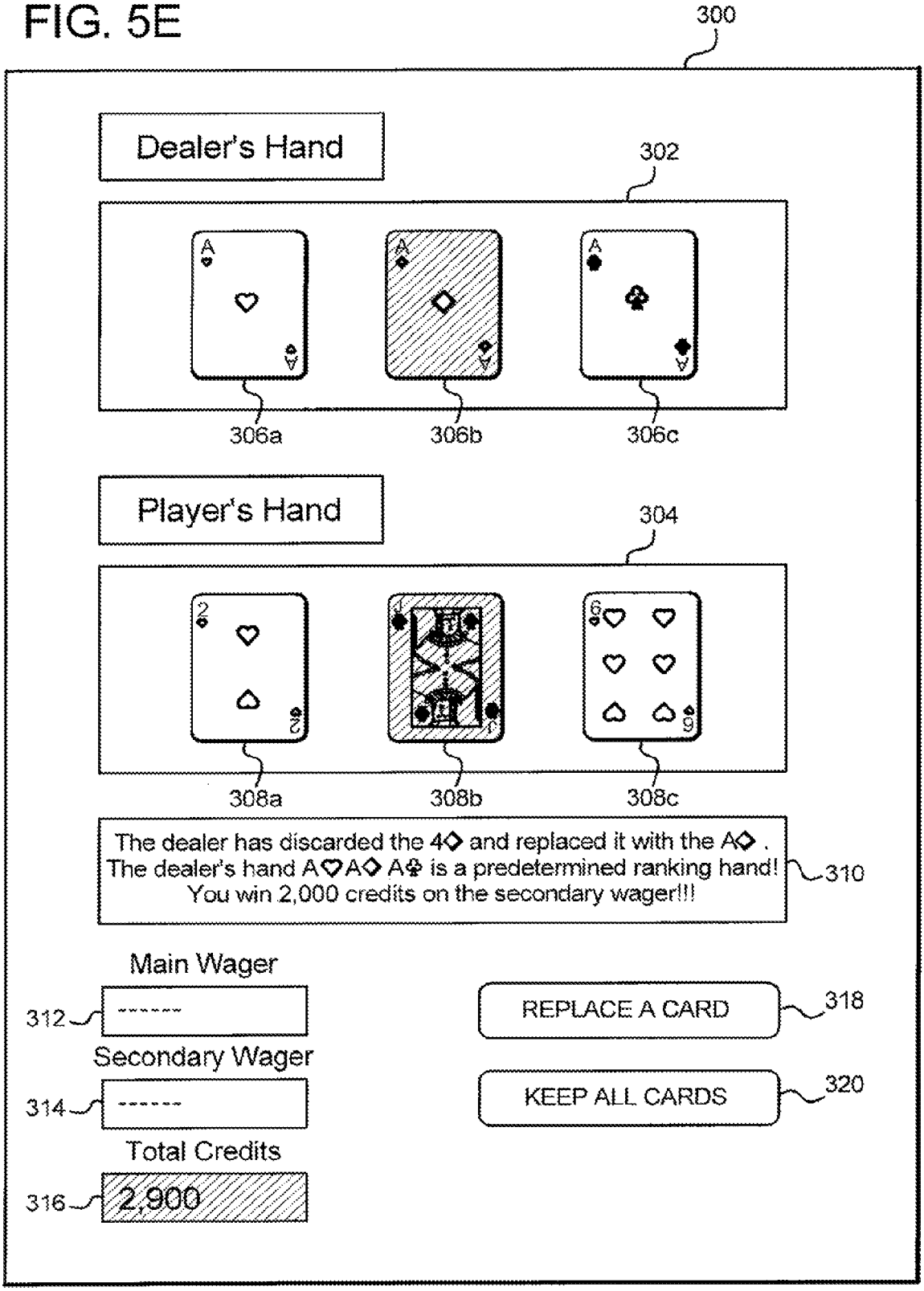

As illustrated in FIG. 5E, even though the initial dealer hand has clearly beaten the player's final hand, the gaming device may still be required to replace a card according to the house rules, as discussed above. In an embodiment, if the dealer hand is better than or equal to the player's final hand, the gaming device should nevertheless replace the card that would potentially result in the highest ranking hand. In this example, as the dealer hand is A♥ 4♦ A♣, the decision to replace a card is obvious. The gaming device must discard the 4♦ to try for the higher ranking Three-of-a-Kind hand.

In this example, the replacement card 306*c* for the dealer hand is an A♦, as indicated by the message display 310. In this example, the highest ranking hand of the player's hand and the dealer hand is the Three-of-a-Kind in the dealer hand (i.e., A♥A♦A♣). In this example, this is one of the plurality of predetermined hands that pays on the secondary wager. Accordingly, the player wins 40:1 on the secondary wager (i.e., 2,000 credits), as indicated by the message display 310. Therefore, even though a player may feel frustration at losing the main wager, there is great player excitement when the player achieves one of the predetermined hands. Likewise, if the player were to achieve a predetermined hand such as A♥A♦A♣, the player would win not only on the primary wager, but also win on the secondary wager. It should also be appreciated that if the player had not placed the optional secondary wager, the gaming device would not replace a card in the dealer hand because the player would not have been eligible to win the secondary award.

Although the Three Card Draw Poker game has been described above where all of the cards are dealt face-up to the player and the cards of the dealer hand are dealt face-down, it should be appreciated that one or more of the player's cards may be dealt face down and/or one or more of the dealer cards may be dealt face-up. For example, all cards for both the player hand and the dealer hand could be dealt face-up. Alternatively, both the player hand and the dealer hand each receive two cards face-up and one card face-down. In this example, the player then has the option to replace one of the cards. In one embodiment, if the player replaces a face-down card, the replacement card is also dealt face-down. Therefore, prior to the player replacing a card, both the player and the gaming device do not know the identity of one of the cards in the competing hand. After the player has made a replacement, the gaming device reveals the face-down card in the dealer hand to the player. At this point, the gaming device may replace one of the three cards in the dealer hand based on incomplete information and certain assumptions about the non-visible card in the player's hand.

Figure 6:
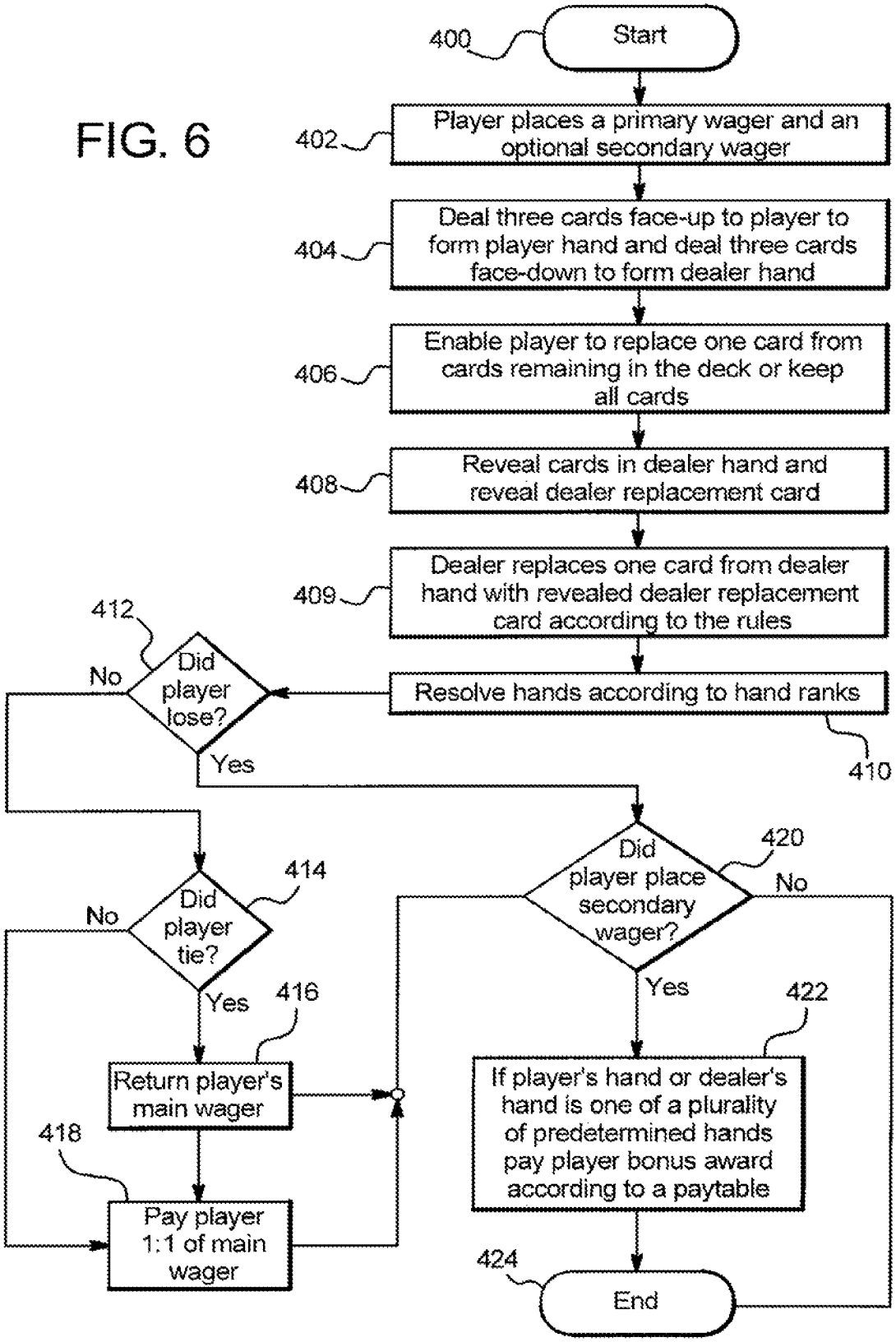
FIG. 6 is a flow diagram of an embodiment, where the gaming device selects a replacement card after the dealer's replacement card is revealed.

The operation of one embodiment of the present disclosure is generally illustrated in FIG. 6. FIG. 6 includes a general overview of the operation of one embodiment of the gaming system where the game is a Three Card Draw Poker game where the dealer is able to replace one of the cards in the dealer hand after the cards in the dealer hand and the replacement cards are revealed. The gaming system initiates the poker game as indicated in step 400. The gaming device prompts the player to make a required primary wager and an optional secondary wager, as indicated by block 402. In an embodiment, if a player places the secondary wager, the player is eligible for a bonus award depending on the final dealer hand, the player's final hand, or a combination of the final dealer hand and the player's final hand. In one embodiment, any bonus awards are based on the strongest final hand, which may be either the player hand or the dealer hand and is determined according to a pay table.

After the primary wager and optional secondary wager have been placed, the gaming device deals three cards face-up to form a player hand and three cards face-down to for a dealer hand, as indicated by block 404. In one embodiment, all of the cards for the player hand and the dealer hand are dealt from a standard deck of fifty-two cards. In a table game, the cards are dealt from a pre-shuffled standard physical deck of cards. In an individual video based gaming console, the cards are dealt from a virtual deck of fifty-two cards. It should be appreciated that in other embodiments, the Three Card Draw Poker game may be dealt from two or more decks of cards, and these decks may contain one or more Jokers. In one or more Jokers are available in the deck, such Jokers may be assigned usage rules including, but not limited to, being treated as a general Wild card which substitutes for any other card, or being treated as a Pai Gow Poker style Joker, as discussed above.

In this embodiment, the dealer cards are dealt face-down. After the three cards have been dealt to form a player hand and a dealer hand, the gaming device enables the player to replace one card, as indicated by block 406. The player may choose to keep all three cards if the player believes that his or her hand is strong enough as is.

After the player has received a replacement card, the gaming device reveals the cards in the dealer hand and reveals the dealer replacement card, as indicated by block 408. In this embodiment, the gaming device is able to replace one of the cards in the initial dealer hand with knowledge of the replacement card rather than having to replace a card in the dealer hand blind. Therefore, the gaming device has a certain advantage over the player because the player must determine whether to replace a cared in the player hand without knowledge of the player's replacement card. After the cards in the dealer hand and the dealer replacement card is revealed, the gaming device replaces none or one card in the dealer's hand with the replacement dealer card, as indicated by block 409. In an embodiment, the dealer determines whether or not to replace a card according to set of house rules. The house rules include a set of rules that apply when the dealer's initial hand is better than the player's final hand and a set of rules that apply when the player's final hand is better than the dealer's hand, as discussed above with reference to FIG. 3.

Referring back to FIG. 6, after the gaming device has replaced up to one card according the above described or other suitable rules, the hands are resolved, as indicated by block 410. If the rank of the player's hand is less than the rank of the dealer hand, the player loses the primary wager. If the rank of the player's hand is the same as the rank of the dealer hand, the gaming device returns the player's primary wager to the player, as indicated by decision diamonds 412, 414 and block 416. It should be appreciated that in another embodiment, if the player hand ties the dealer hand, the player loses the primary wager. If the rank of the player's hand is greater than the rank of the dealer hand, the gaming device pays the player 1:1 of the main wager, as indicated by decision diamonds 412, 414 and block 418. However, it should be appreciated that any suitable payoff ratio other than 1:1 may be used.

After the primary wager payoff has been determined, the gaming device determines if the player placed a secondary wager, as indicated by decision diamond 420. If the player did not place the secondary wager, the game ends, as indicated in step 424. If the player placed the secondary wager, and if the highest ranking hand of the dealer hand and the player's hand is a predetermined rank, the gaming device provides the player with a bonus award according to a pay table. After the dealer pays the player the bonus award, the game ends, as indicated in step 424.

Figure 7:
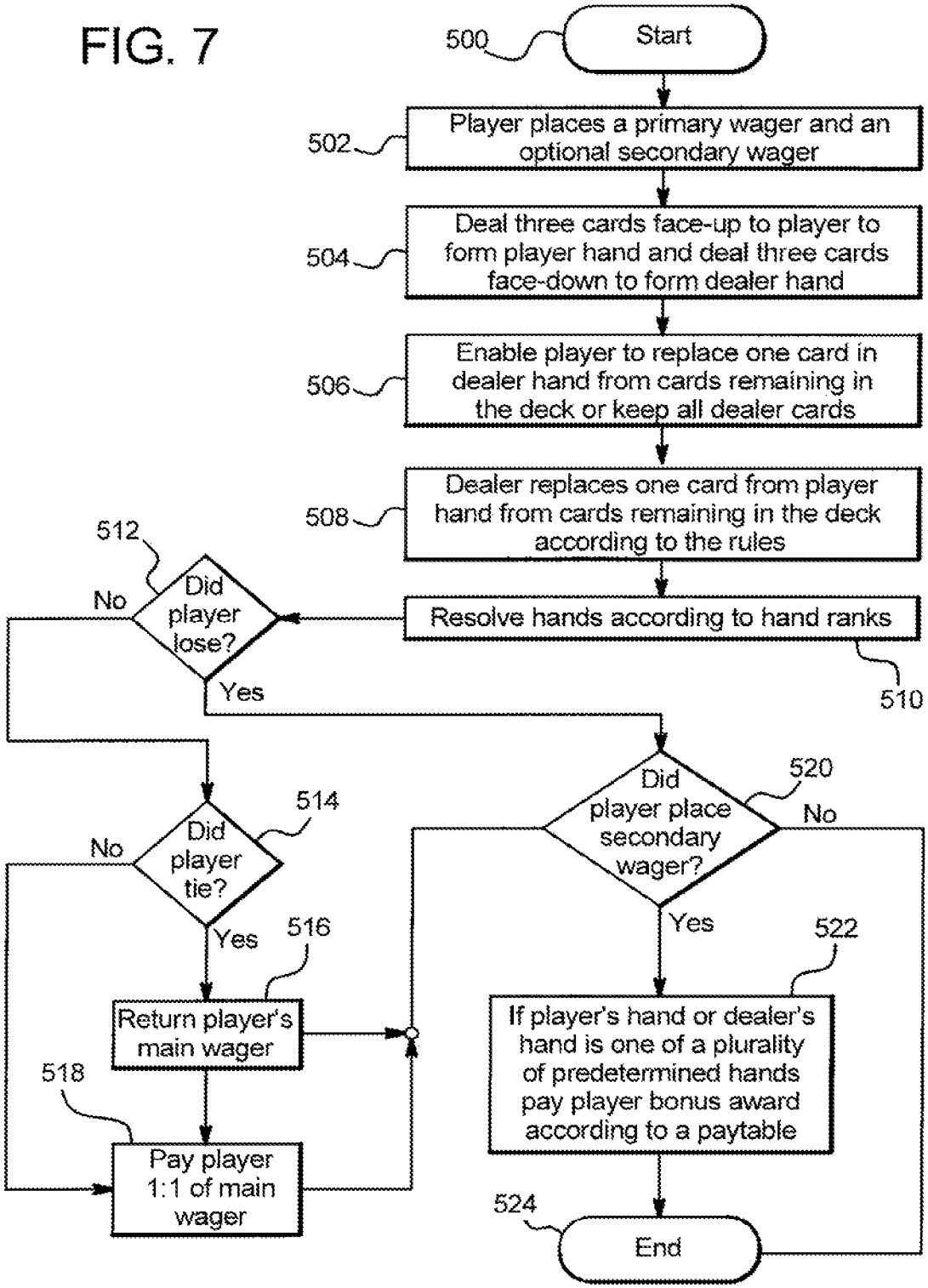
FIG. 7 is a flow diagram of an embodiment, where the player selects one of the cards in the dealer hand to be replaced, and the dealer selects one of the cards in the player hand to be replaced.

The operation of one embodiment of the present disclosure is generally illustrated in FIG. 7. FIG. 7 includes a general overview of the operation of one embodiment of the gaming system where the game is a Three Card Draw Poker game where the player selects up to one of the cards in the dealer hand to be replaced and the gaming device replaces up to one of the cards in the player hand based on the rules of the game. The gaming system initiates the poker game as indicated in step 500. The gaming device prompts the player to make a required primary wager and an optional secondary wager, as indicated by block 502. In an embodiment, if a player places the secondary wager, the player is eligible for a bonus award depending on the final dealer hand, the player's final hand, or a combination of the final dealer hand and the player's final hand. In one embodiment, any bonus awards are based on the strongest final hand, which may be either the player hand or the dealer hand and is determined according to a pay table.

After the primary wager and optional secondary wager have been placed, the gaming device deals three cards face-up to form a player hand and three cards face-up to for a dealer hand, as indicated by block 504.

After the three cards have been dealt to form a player hand and three cards have been dealt to form a dealer hand, the gaming device enables the player to replace one card in the dealer's hand, as indicated by block 506. The player may choose to keep all three cards in the dealer hand if the player believes that the rank of the dealer hand would improve by replacing a card. In this embodiment, because the player has a certain amount of control over the cards in the dealer hand, the player should select a card to replace in the dealer hand only if it appears that the final rank of the dealer hand would be lessened by a card replacement. That is, the player would make a decision that result in the lowest possible ranking of the final dealer hand in order to maximize the chances that the final player hand will win.

After the player has optionally selected a replacement card for the dealer hand, the gaming device reveals the dealer replacement card. After the dealer replacement card is revealed, the gaming device replaces none or one card in the player hand with one of the cards remaining in the deck, as indicated by block 510. In an embodiment, the dealer determines whether or not to replace a card in the player's initial hand according to set of house rules, as discussed above with reference to FIG. 3. In one embodiment, the player is able to view the possible dealer replacement card prior to selecting whether or not to replace a card in the initial dealer hand, and the gaming device is able to view the possible player replacement card prior to selecting whether or not to replace a card in the initial player hand. In one embodiment, the player is not able to view the possible dealer replacement card prior to selecting whether or not to replace a card in the initial dealer hand, and the gaming device is also not able to view the possible player replacement card prior to selecting whether or not to replace a card in the initial player hand. In another embodiment, the player is not able to view the possible dealer replacement card prior to selecting whether or not to replace a card in the initial dealer hand, and the gaming device is able to view the possible player replacement card prior to selecting whether or not to replace a card in the initial player hand.

Referring back to FIG. 7, after the gaming device has replaced up to one card according the above described or other suitable rules, the hands are resolved, as indicated by block 510. If the rank of the player's hand is less than the rank of the dealer hand, the player loses the primary wager. If the rank of the player's hand is the same as the rank of the dealer hand, the gaming device returns the player's primary wager to the player, as indicated by decision diamonds 512, 514 and block 516. It should be appreciated that in another embodiment, if the player hand ties the dealer hand, the player loses the primary wager. If the rank of the player's hand is greater than the rank of the dealer hand, the gaming device pays the player 1:1 of the main wager, as indicated by decision diamonds 512, 514 and block 518. However, it should be appreciated that any suitable payoff ratio other than 1:1 may be used.

After the primary wager payoff has been determined, the gaming device determines if the player placed a secondary wager, as indicated by decision diamond 520. If the player did not place the secondary wager, the game ends, as indicated in step 524. If the player placed the secondary wager, and if the highest ranking hand of the dealer hand and the player's hand is a predetermined rank, the gaming device provides the player with a bonus award according to a pay table. After the dealer pays the player the bonus award, the game ends, as indicated in step 524.

In one embodiment, the gaming device incorporates a Three Card Draw Poker game where the gaming device deals the player three cards face-up to form a player hand and three cards face-down to form a dealer hand. In this embodiment, the player places an initial wager and then the gaming device deals the player hand and the dealer hand. After the player has viewed the cards in the initial player hand, the player must place a secondary wager in order to proceed in the play of the game. For example, the player must place a secondary wager equal to a certain proportion of the player's initial wager, such as equal to 1× the amount of the initial wager. If the player does not place the required secondary wager, the player forfeits the hand and the initial wager, and the round of play of the game ends. If the player thinks the hand may be a potential winning hand, the player places the required secondary wager and the play of the game continues. After the player has placed the required secondary wager, the player can optionally replace one card in the player hand with a card in the deck. Similarly, the gaming device replaces up to one card in the dealer hand with a card in the deck, as also discussed above. The ranks of the final dealer hand and player hand are resolved and if the rank of the final player hand is greater than the rank of the final dealer hand, the gaming device provides the player with an award. Therefore, in this embodiment, if the player considers that the player's starting hand is of a sufficient rank, the player can choose to double their initial wager. Similarly, if the player's initial hand is a poor hand, the player can fold the hand to limit their bet exposure and potential losses.

In one embodiment, the gaming device incorporates a Three Card Draw Poker game where the dealer hand must meet a qualifying rule. The gaming device deals the player three cards face-up to form a player hand and three cards face-down to form a dealer hand. In this embodiment, the player places an initial wager and then the gaming device deals the player hand and the dealer hand. After the player has viewed the cards in the initial player hand, the player must place a secondary wager in order to proceed in the play of the game, as discussed above. After the player has placed the required secondary wager, the player can optionally replace one card in the player hand with a card in the deck. However, in this embodiment, the gaming device reveals the initial three card dealer hand and further deals a fourth dealer card face-up. Of the four available dealer cards, the gaming device forms the highest ranking final three card dealer hand. If the final three card dealer is not better than or equal to a predetermined rank (e.g., K-8-3 or a pair of 4's) then the final dealer hand does not qualify. If the dealer hand does not qualify, the gaming device pays all player's 1:1 (or other suitable payout ratio) on their initial wagers. Also, in this scenario where the final three card dealer hand does not quality, each of the player's secondary wager are refunded to the player. If the final three card dealer hand does qualify, then the gaming device compares the rank of the final three card dealer hand and the final player hands and pays any winning player hands. The payouts or awards for the winning player hands are based on the respective initial wagers and the secondary wagers.

In one embodiment, the gaming device incorporates a Three Card Draw Poker game where the player is able to optionally purchase a replacement card. The gaming device deals the player three cards face-up to form a player hand and three cards face-down to form a dealer hand. In this embodiment, the player places an initial wager and then the gaming device deals the player hand and the dealer hand. After the player has viewed the cards in the initial player hand, the player can choose to keep the originally dealt player hand or purchase a replacement card. In this embodiment, the cost of the replacement card is equal to a certain proportion of the player's initial wager, such as equal to 1× the initial player wager. In this embodiment, even if the player does not choose to place the secondary wager and replace one of the initial player cards, the play of the game continues. After the player has optionally chosen to purchase a replacement card and any replacement card has been dealt, the gaming device replaces one of the cards in the dealer hand according to the rules, as discussed above. The ranks of the final dealer hand and final player hands are determined and the gaming device provides an award for each winning hand. Therefore, in this embodiment, if the player has a sufficiently high ranking initial hand and does not want to replace a card, the player is not required to wager additional amounts in the play of the game.

For any of the Three Card Draw Poker embodiments discussed above, it should be appreciated that one or more of the three cards in the initial dealer hand may be revealed prior to the player making a decision to replace one of the player cards. In one such embodiment, one of the cards in the initial dealer hand is revealed. In another such embodiment, two of the cards in the initial dealer hand are revealed.

In one embodiment of a Three Card Draw Poker game, the gaming device provides the player with an enhanced award if the rank of the final player hand is of a sufficient high rank. For example, if the final player hand included A-A-A, the gaming device would provide the player more than 1:1 payout on the original wager or wagers.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device that stores a plurality of instructions which, when executed by the at least one processor, cause the at least one processor to operate with the at least one display device and the at least one input device to:

(a) receive a primary wager from a player for a play of a card game associated with a set of a plurality of cards;

(b) select three cards from the set of cards to form a player hand and display at least one of the cards in the player hand face-up;

(c) select three cards from the set of cards to form a dealer hand and display at least one of the cards in the dealer hand face-down;

(d) enable the player to select one of the cards in the player hand to replace;

(e) if a selection of one of the cards in the player hand is received, replace the selected card with a player replacement card selected from the set of cards;

(f) determine whether to replace one of the cards in the dealer hand based on: (i) a set of predetermined rules, and (ii) the cards in the player hand;

(g) if it is determined to replace one of the cards in the dealer hand, replace said card in the dealer hand with a dealer replacement card selected from the set of cards;

(h) compare a value of the player hand with a value of the dealer hand; and (i) display a primary award if the value of the player hand is greater than the value of the dealer hand.

2. The gaming system of claim 1, wherein the plurality of instructions, when executed by the at least one processor, cause the at least one processor to operate with the at least one input device to enable the player to place a secondary wager.

3. The gaming system of claim 2, wherein the plurality of instructions, when executed by the at least one processor, cause the at least one processor to, if the secondary wager is received, operate with the at least one display device to display a secondary award if one of: (a) the value of the player hand, and (b) the value of the dealer hand is one of a plurality of predetermined values.

4. The gaming system of claim 1, wherein the plurality of instructions, when executed by the at least one processor, cause the at least one processor to operate with the at least one display device to display the dealer replacement card prior to replacing any card in the dealer hand with the dealer replacement card.

5. The gaming system of claim 1, wherein the predetermined rules require replacement of one of the cards in the dealer hand if the value of the dealer hand exceeds the value of the player hand and if replacing said card could result in an improvement in the value of the dealer hand.

6. The gaming system of claim 1, wherein the plurality of instructions, when executed by the at least one processor, cause the at least one processor to operate with the at least one input device to enable the player to select one of the cards in the player hand to replace if replacing said card could result in the value of the player hand exceeding the value of the dealer hand.

7. A method of operating a gaming system, said method comprising:

(a) causing at least one processor to execute a plurality of instructions stored in at least one memory device to operate with at least one input device to receive a primary wager from a player for a play of a card game associated with a set of a plurality of cards;

(b) causing the at least one processor to execute the plurality of instructions to select three cards from the set of cards to form a player hand and operate with at least one display device to display at least one of the cards in the player hand face-up;

(c) causing the at least one processor to execute the plurality of instructions to select three cards from the set of cards to form a dealer hand and operate with the at least one display device to display at least one of the cards in the dealer hand face-down;

(d) enabling the player to select one of the cards in the player hand to replace;

(e) if a selection of one of the cards in the player hand is received, causing the at least one processor to execute the plurality of instructions to operate with the at least one display device to replace the selected card with a player replacement card selected from the set of cards;

(f) causing the at least one processor to execute the plurality of instructions to determine whether to replace one of the cards in the dealer hand based on: (i) a set of predetermined rules, and (ii) the cards in the player hand;

(g) if it is determined to replace one of the cards in the dealer hand, causing the at least one processor to execute the plurality of instructions to operate with the at least one display device to replace said card in the dealer hand with a dealer replacement card selected from the set of cards;

(h) causing the at least one processor to execute the plurality of instructions to compare a value of the player hand with a value of the dealer hand; and (i) causing the at least one processor to execute the plurality of instructions to operate with the at least one display device to display a primary award if the value of the player hand is greater than the value of the dealer hand.

8. The method of claim 7, which includes enabling the player to place a secondary wager.

9. The method of claim 8, which includes causing the at least one processor to execute the plurality of instructions to, if the secondary wager is received, operate with the at least one display device to display a secondary award if one of: (a) the value of the player hand, and (b) the value of the dealer hand is one of a plurality of predetermined values.

10. The method of claim 7, which includes causing the at least one processor to execute the plurality of instructions to operate with the at least one display device to display the dealer replacement card prior to replacing any card in the dealer hand with the dealer replacement card.

11. The method of claim 7, wherein the predetermined rules require replacement of one of the cards in the dealer hand if the value of the dealer hand exceeds the value of the player hand and if replacing said card could result in an improvement in the value of the dealer hand.

12. The method of claim 7, which includes enabling the player to select one of the cards in the player hand to replace if replacing said card could result in the value of the player hand exceeding the value of the dealer hand.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

(a) operate with at least one input device to receive a primary wager from a player for a play of a card game associated with a set of a plurality of cards;

(b) select three cards from the set of cards to form a player hand and cause at least one display device to display at least one of the cards in the player hand face-up;

(c) select three cards from the set of cards to form a dealer hand and cause the at least one display device to display at least one of the cards in the dealer hand face-down;

(d) enable the player to select one of the cards in the player hand to replace;

(e) if a selection of one of the cards in the player hand is received, cause the at least one display device to replace the selected card with a player replacement card selected from the set of cards;

(f) determine whether to replace one of the cards in the dealer hand based on: (i) a set of predetermined rules, and (ii) the cards in the player hand;

(g) if it is determined to replace one of the cards in the dealer hand, cause the at least one display device to replace said card in the dealer hand with a dealer replacement card selected from the set of cards;

(h) compare a value of the player hand with a value of the dealer hand; and (i) cause the at least one display device to display a primary award if the value of the player hand is greater than the value of the dealer hand.

16. The non-transitory computer readable medium of claim 15, wherein the plurality of instructions, when executed by the at least one processor, cause the at least one processor to operate with the at least one input device to enable the player to place a secondary wager.

17. The non-transitory computer readable medium of claim 16, wherein the plurality of instructions, when executed by the at least one processor, cause the at least one processor to, if the secondary wager is received, cause the at least one display device to display a secondary award if one of: (a) the value of the player hand, and (b) the value of the dealer hand is one of a plurality of predetermined values.

18. The non-transitory computer readable medium of claim 15, wherein the plurality of instructions, when executed by the at least one processor, cause the at least one processor to cause the at least one display device to display the dealer replacement card prior to replacing any card in the dealer hand with the dealer replacement card.

19. The non-transitory computer readable medium of claim 15, wherein the predetermined rules require replacement of one of the cards in the dealer hand if the value of the dealer hand exceeds the value of the player hand and if replacing said card could result in an improvement in the value of the dealer hand.

20. The non-transitory computer readable medium of claim 15, wherein the plurality of instructions, when executed by the at least one processor, cause the at least one processor to operate with the at least one input device to enable the player to select one of the cards in the player hand to replace if replacing said card could result in the value of the player hand exceeding the value of the dealer hand.

* * * * *